US008877031B2

(12) United States Patent
Suda et al.

(10) Patent No.: US 8,877,031 B2
(45) Date of Patent: Nov. 4, 2014

(54) METHOD OF ELECTROLYTIC CERAMIC COATING FOR METAL, ELECTROLYSIS SOLUTION FOR ELECTROLYTIC CERAMIC COATING FOR METAL, AND METALLIC MATERIAL

(75) Inventors: Arata Suda, Kanagawa (JP); Tomoyoshi Konishi, Kanagawa (JP)

(73) Assignee: Nihon Parkerizing Co., Ltd., Tokyo (JP)

( * ) Notice: Subject to any disclaimer, the term of this patent is extended or adjusted under 35 U.S.C. 154(b) by 706 days.

(21) Appl. No.: 13/138,007

(22) PCT Filed: Dec. 10, 2009

(86) PCT No.: PCT/JP2009/070657

§ 371 (c)(1), (2), (4) Date: Jun. 22, 2011

(87) PCT Pub. No.: WO2010/073916

PCT Pub. Date: Jul. 1, 2010

(65) Prior Publication Data

US 2012/0000783 A1 Jan. 5, 2012

(30) Foreign Application Priority Data

Dec. 26, 2008 (JP) ..... 2008-333684

(51) Int. Cl.

| | |
|---|---|
| ***C25D 9/06*** | (2006.01) |
| ***C25D 11/02*** | (2006.01) |
| ***C25D 11/26*** | (2006.01) |
| ***C25D 11/30*** | (2006.01) |
| ***C25D 11/12*** | (2006.01) |
| ***C25D 11/04*** | (2006.01) |
| ***C25D 11/06*** | (2006.01) |

(52) U.S. Cl.

CPC ..... *C25D 11/04* (2013.01); *C25D 11/26* (2013.01); *C25D 11/30* (2013.01); *C25D 11/12* (2013.01); *C25D 11/06* (2013.01); *C25D 11/026* (2013.01)

USPC ..... 205/316; 205/109; 205/321; 205/322; 205/323

(58) Field of Classification Search

USPC ..... 205/316, 321, 322, 323

See application file for complete search history.

(56) References Cited

U.S. PATENT DOCUMENTS

| | | | | |
|---|---|---|---|---|
| 4,082,626 | A | 4/1978 | Hradcovsky | |
| 5,616,229 | A | 4/1997 | Samsonov et al. | |
| 6,365,028 | B1 | 4/2002 | Shatrov | |
| 6,797,147 | B2 * | 9/2004 | Dolan | 205/316 |
| 6,916,414 | B2 * | 7/2005 | Dolan | 205/316 |
| 2008/0093223 | A1 * | 4/2008 | Yoshioka et al. | 205/322 |
| 2010/0025253 | A1 * | 2/2010 | Yoshioka et al. | 205/50 |

FOREIGN PATENT DOCUMENTS

| | | |
|---|---|---|
| JP | 58-017278 | 4/1983 |
| JP | 59-028636 | 7/1984 |
| JP | 59-028637 | 7/1984 |
| JP | 09-310184 | 12/1997 |
| JP | 2002-508454 | 3/2002 |
| JP | 2008-081812 | 4/2008 |
| WO | WO 2005/118919 | 12/2005 |

* cited by examiner

*Primary Examiner* — Bryan D. Ripa

(74) *Attorney, Agent, or Firm* — Flynn, Thiel, Boutell & Tanis, P.C.

(57) ABSTRACT

The electrolysis solution for electrolytic ceramic coating includes water, a water-soluble zirconium compound, a complexing agent, carbonate ion, and at least one member selected from the group consisting of an alkali metal ion, ammonium ion and an organic alkali. Te zirconium compound is included at a concentration (X) in terms of zirconium of 0.0001 to 1 mol/L, the complexing agent is included at a concentration (Y) of 0.0001 to 0.3 mol/L, the carbonate ion is included at a concentration (Z) of 0.0002 to 4 mol/L, a ratio of the concentration (Y) of the complexing agent to the concentration (X) in terms of zirconium (Y/X) is at least 0.01, a ratio of the concentration (Z) of the carbonate ion to the concentration (X) in terms of zirconium (Z/X) is at least 2.5, and the electrolysis solution has an electrical conductivity of 0.2 to 20 S/m.

17 Claims, No Drawings

METHOD OF ELECTROLYTIC CERAMIC COATING FOR METAL, ELECTROLYSIS SOLUTION FOR ELECTROLYTIC CERAMIC COATING FOR METAL, AND METALLIC MATERIAL

TECHNICAL FIELD

The present invention relates to a method of forming a ceramic film on a surface of metal by electrolytic treatment, and an electrolysis solution that may be advantageously used to electrolytically coating the metal with the ceramic film. The invention also relates to a metallic member having the ceramic film.

BACKGROUND ART

When a sliding member is produced from a light metal such as an aluminum alloy, a ceramic film is generally formed on the sliding part of the sliding member by anodizing treatment, electroplating or vapor phase epitaxy to impart wear resistance to the sliding member. The anodizing treatment for use in forming a wear-resistant film on a valve metal typified by aluminum is excellent in the throwing power and in the reduced environmental load because of the non-use of chromium and nickel, and is therefore widely adopted.

Of such anodized films, particularly an anodized film having excellent wear resistance is called a hard anodized film. The hard anodized film is generally formed by a low temperature method. The low temperature method involves anodizing in a sulfuric acid-based electrolytic bath at a bath temperature of up to 10° C. In addition, in the low temperature method, the anodizing treatment is performed at a relatively high current density of 3 to 5 A/dm$^2$ compared to other anodization methods. The hard anodized film obtained by the low temperature method typically has a Vickers hardness of 300 to 500 Hv, and is more compact than other anodized films.

Hard anodized films are currently used, for example, in the sliding part of aluminum alloy machine components, and with the increase in the severity of the sliding conditions, further improvement in the wear resistance is awaited. It is difficult to form a hard and compact anodized film on die casting aluminum alloys.

Anode spark discharge methods in which a spark discharge is used to form a film are also known to form a film with a high surface hardness (see, for example, Patent Literatures 1 to 3). In the conventional anode spark discharge methods, alkali metal silicates, alkali metal hydroxides, and oxygen acid catalysts have been used in the electrolysis solution.

Patent Literatures 1 and 3 describe methods of forming a super-hard film containing α-alumina as its main ingredient by the treatment using a voltage as high as at least 600 V. The film obtained by these methods has an extremely high hardness as represented by the Vickers hardness exceeding 1,500 Hv. In addition, while the thickness of the film that can be formed by the anodizing treatment using an ordinary alkaline electrolysis solution is approximately 10 μm, the thickness of the film formed by these methods may be as thick as 100 μm or more. Accordingly, a film having excellent wear resistance and corrosion resistance can be formed by increasing the thickness of the film.

Other anode spark discharge methods have also been disclosed. Patent Literatures 4 to 6 each describe a method which uses an electrolysis solution of substantially the same composition as that in Patent Literature 3 and a special current waveform to form a film on the surface of a substrate more efficiently than in the method described in Patent Literature 3.

Patent Literature 7 describes an anode spark discharge method in which the smoothness, hardness, and film-forming rate have been improved by using a silicate in combination with lithium ion and sodium or potassium ion.

Patent Literature 8 describes a method of electrolytic ceramic coating on metal wherein an electrolytic treatment is performed using the metal as an anode in an electrolysis solution containing a zirconium compound to form a ceramic film on the surface of the metal.

Patent Literature 9 describes a method for coating a metal with a ceramic film comprising the step of causing glow discharge and/or arc discharge on a surface of a metal substrate which is used as a working electrode in an electrolysis solution to electrolytically form the ceramic film on the surface of the metal substrate, wherein the electrolysis solution contains zirconium oxide particles having an average particle size of up to 1 μm in a content X, and a compound other than the zirconium oxide which is a compound of at least one element selected from the group consisting of Mg, Al, Si, Ca, Sc, Ti, V, Cr, Mn, Fe, Co, Ni, Cu, Zn, Ga, Ge, Sr, Y, Zr, Nb, Mo, Tc, Ru, Rh, Pd, Ag, In, Sn, Ba, La, Hf, Ta, W, Re, Os, Ir, Pt, Au, Bi, Ce, Nd, Gd, and Ac in a content of Y, and the X and the Y satisfy the following relations (1) to (3) and the electrolysis solution has a pH of at least 7.0.

$$0.05\ \text{g/L} \le X \le 500\ \text{g/L} \quad (1)$$

$$0\ \text{g/L} \le Y \le 500\ \text{g/L} \quad (2)$$

$$0 \le Y/X \le 10 \quad (3)$$

CITATION LIST

Patent Literature

Patent Literature 1: JP 2002-508454 A
Patent Literature 2: U.S. Pat. No. 4,082,626
Patent Literature 3: U.S. Pat. No. 5,616,229
Patent Literature 4: JP 58-17278 B
Patent Literature 5: JP 59-28636 B
Patent Literature 6: JP 59-28637 B
Patent Literature 7: JP 9-310184 A
Patent Literature 8: WO 2005/118919
Patent Literature 9: JP 2008-81812 A

SUMMARY OF INVENTION

Technical Problems

However, the films obtained by the conventional anode spark discharge methods described in Patent Literatures 1 to 3 have high surface roughness, high hardness and low toughness and therefore, when used in sliding members without being polished, may cause wearing and scratching of the counterpart members. In other words, the films have an extremely high likelihood of attacking the counterpart members. Accordingly, the films obtained by the conventional anode spark discharge methods cannot be used in sliding members unless polished. The films have poor adhesion to the substrate metal and therefore easily come off during the sliding movement. This is a particularly important defect.

The methods described in Patent Literatures 4 to 6 suffer from poor hardness of the resulting films and low film-forming rate.

The method described in Patent Literature 7 cannot achieve the hardness and wear resistance of the same levels as those of the film obtained by the method described in Patent Literature 3.

The method described in Patent Literature 8 is capable of forming, on a metal surface, a thin film having high hardness, excellent wear resistance, excellent tenacity and a low likelihood of attacking the counterpart member even when used in a sliding member without being polished, and such a thin film has not been obtainable by the conventional anodization methods such as the anode spark discharge methods. Accordingly, this method is useful. However, the electrolysis solution has poor stability and zirconium ion is converted into zirconium hydroxide to form a white precipitate (sludge) depending on the pH condition of the electrolysis solution used and the electrolysis conditions. As a result, there are cases in which a desired film cannot be formed or the method is not efficient in terms of industrial production because of the short replacement cycle of the electrolysis solution and the necessity to use large amounts of zirconium compounds. In addition, the adhesion, smoothness and film-forming rate of the ceramic film formed is to be further improved.

The method described in Patent Literature 9 is capable of forming a compact film on various types of metal substrates such as a magnesium alloy substrate and the resulting film has excellent wear resistance, a low likelihood of attacking the counterpart member and excellent corrosion resistance, and therefore this method is useful. However, the adhesion, smoothness and film-forming rate of the film formed by this method as well as the stability of the electrolysis solution used are to be further improved.

In view of the situation as described above, an object of the invention is to provide a method of electrolytic ceramic coating on metal, the method being capable of efficiently forming a thin film having high hardness, excellent wear resistance, excellent toughness and a low likelihood of attacking the counterpart member even when the film is applied to a sliding member without being polished. Another object of the invention is to provide an electrolysis solution used in this method which is stable and withstands industrial use.

Still another object of the invention is to provide a metal member having excellent wear resistance and sliding properties.

Solution to Problems

In order to achieve the above objects, the invention provides the following:

(1) An electrolysis solution for electrolytic ceramic coating used in a method of electrolytic ceramic coating on metal in which at least one metal selected from the group consisting of aluminum, an aluminum alloy, magnesium, a magnesium alloy, titanium and a titanium alloy is used as an anode to anodize a surface of the anode in the electrolysis solution as glow discharge and/or arc discharge is generated to thereby form a ceramic film on the surface of the metal, wherein the electrolysis solution comprises water, a water-soluble zirconium compound, a complexing agent, carbonate ion, and at least one member selected from the group consisting of an alkali metal ion, ammonium ion and an organic alkali, 1) the zirconium compound is included at a concentration (X) in terms of zirconium of 0.0001 to 1 mol/L, 2) the complexing agent is included at a concentration (Y) of 0.0001 to 0.3 mol/L, 3) the carbonate ion is included at a concentration (Z) of 0.0002 to 4 mol/L, 4) a ratio of the concentration (Y) of the complexing agent to the concentration (X) in terms of zirconium (Y/X) is at least 0.01, 5) a ratio of the concentration (Z) of the carbonate ion to the concentration (X) in terms of zirconium (Z/X) is at least 2.5, and 6) the electrolysis solution has an electrical conductivity of 0.2 to 20 S/m.

(2) The electrolysis solution for electrolytic ceramic coating according to (1), wherein the electrolysis solution further comprises poorly soluble particles of at least one member selected from the group consisting of an oxide, a hydroxide, a nitride and a carbide, and wherein the poorly soluble particles are included at a concentration of 0.01 to 100 g/L.

(3) The electrolysis solution for electrolytic ceramic coating according to (1) or (2), further comprising at least one metallic ion selected from the group consisting of silicon, titanium, aluminum, niobium, yttrium, magnesium, copper, zinc, scandium and cerium at a concentration in terms of elemental metal of 0.0001 to 1 mol/L.

(4) The electrolysis solution for electrolytic ceramic coating according to any one of (1) to (3), wherein the electrical conductivity is 0.5 to 10 S/m.

(5) The electrolysis solution for electrolytic ceramic coating according to any one of (1) to (4), wherein the zirconium compound is a zirconium carbonate compound.

(6) The electrolysis solution for electrolytic ceramic coating according to any one of (1) to (5), wherein the metal used as the anode is aluminum or an aluminum alloy and the electrolysis solution has a pH of 7 to 12.

(7) The electrolysis solution for electrolytic ceramic coating according to any one of (1) to (5), wherein the metal used as the anode is magnesium or a magnesium alloy and the electrolysis solution has a pH of 9 to 14.

(8) The electrolysis solution for electrolytic ceramic coating according to any one of (1) to (5), wherein the metal used as the anode is titanium or a titanium alloy and the electrolysis solution has a pH of 7 to 14.

(9) The electrolysis solution for electrolytic ceramic coating according to any one of (1) to (8), further comprising a water-soluble phosphate compound at a concentration in terms of phosphorus of 0.001 to 1 mol/L.

(10) A method of electrolytic ceramic coating on metal in which at least one metal selected from the group consisting of aluminum, an aluminum alloy, magnesium, a magnesium alloy, titanium and a titanium alloy is used as an anode and an application means at least part of which shows a positive side is used to perform an anodizing treatment of a surface of the anode in the electrolysis solution for electrolytic ceramic coating according to any one of (1) to (9) as glow discharge and/or arc discharge is generated to thereby form a ceramic film on the surface of the metal, wherein an average current density during positive side application is in a range of 0.5 to 40 A/dm$^2$, and wherein the anodizing treatment is performed at a positive side duty ratio (T1) of 0.02 to 0.5, a negative side duty ratio (T2) of 0 to 0.5, a non-application time ratio per unit time (T3) of 0.35 to 0.95, and these ratios simultaneously meet the following formulas:

$$0 \leq T2/T1 \leq 10$$

$$0.5 \leq T3/(T1+T2) \leq 20.$$

(11) The method of electrolytic ceramic coating according to (10), wherein at least part of the anodizing treatment is performed by a monopolar electrolysis process in which a positive side application is only made or a bipolar electrolysis process in which a composite application of positive and negative sides is made.

(12) The method of electrolytic ceramic coating according to (10) or (11), wherein at least one voltage waveform is selected from the group consisting of square waveform, sinusoidal waveform, trapezoidal waveform and triangular waveform and has a frequency of 5 to 20,000 Hz, and the current density and/or the voltage on the positive and negative sides is controlled.

(13) The method of electrolytic ceramic coating according to any one of (10) to (12), wherein at least part of the anodizing treatment is performed under voltage control mode and another part of the anodizing treatment is performed under current control mode.

(14) The method of electrolytic ceramic coating according to any one of (11) to (13), wherein in the bipolar electrolysis process, at least part of the anodizing treatment is performed while separately controlling the positive and negative sides according to arbitrarily selected waveforms, is performed under the voltage control mode on both of the positive and negative voltage sides, or is performed under the current control mode on both of the positive and negative voltage sides.

(15) The method of electrolytic ceramic coating according to any one of (11) to (14), wherein in the bipolar electrolysis process, at least part of the anodizing treatment is performed while separately controlling the positive and negative sides according to arbitrarily selected waveforms, and is performed under the voltage control mode on the positive voltage side and under the current control mode on the negative voltage side, or is performed under the current control mode on the positive voltage side and under the voltage control mode on the negative voltage side.

(16) The method of electrolytic ceramic coating according to any one of (10) to (15), wherein a peak voltage during negative side application is controlled in a range of 0 to 350 V in terms of absolute value.

(17) The method of electrolytic ceramic coating, wherein two or more anodizing treatment steps are performed by anodization processes according to any one of (10) to (16) using electrolysis solutions according to any one of (1) to (9), the electrolysis solutions for the respective anodizing treatment steps may be the same or different and the anodization processes for the respective anodizing treatment steps may be the same or different.

(18) A metallic member comprising: a substrate of a metal selected from the group consisting of aluminum, an aluminum alloy, magnesium, a magnesium alloy, titanium and a titanium alloy; and a ceramic film present on a surface of the metal substrate, wherein the ceramic film has a thickness of 0.1 to 100 μm, wherein the ceramic film has a Vickers hardness of 450 to 1,900 Hv, and wherein the ceramic film contains zirconium in an amount of 5 to 70 wt %.

(19) The metallic member according to (18), wherein the ceramic film is formed by the method of electrolytic ceramic coating according to any one of (10) to (17).

(20) The metallic member according to (18) or (19), which is a member selected from the group consisting of engine cylinder, engine piston, engine shaft, engine cover, engine valve, engine cam, engine pulley, turbo housing, turbo fin, vacuum chamber inner wall, compressor inner wall, pump inner wall, aluminum wheel, propeller, gear part, gas turbine, heat sink, printed board and mold.

Advantageous Effects of Invention

The method of electrolytic ceramic coating on metal according to the invention can efficiently form on a metal surface a thin ceramic film which has high hardness, excellent wear resistance, excellent toughness and a low likelihood of attacking the counterpart member when applied to a sliding member without being polished. According to the inventive method of electrolytic ceramic coating on metal, good corrosion resistance can be imparted to the substrate metal even if the film formed is thin.

The electrolysis solution for electrolytic ceramic coating according to the invention withstands industrial use and exhibits good stability, and can be therefore advantageously used in the method of electrolytic ceramic coating on metal according to the invention.

The metallic member of the invention has excellent wear resistance, sliding properties and corrosion resistance.

DESCRIPTION OF EMBODIMENTS

The method of electrolytic ceramic coating on metal, the electrolysis solution for electrolytic ceramic coating on metal and the metallic member according to the invention are described below in detail. The method of electrolytic ceramic coating on metal and the electrolysis solution for electrolytic ceramic coating on metal according to the invention are first described below.

The method of electrolytic ceramic coating on metal according to the invention (hereinafter also referred to as the "method of the invention") is a method in which at least one metal selected from the group consisting of aluminum, an aluminum alloy, magnesium, a magnesium alloy, titanium and a titanium alloy is used as an anode and a voltage waveform at least part of which is a positive voltage portion is used to perform an anodizing treatment in the inventive electrolysis solution for electrolytic ceramic coating on metal as glow discharge and/or arc discharge is generated on a surface of the anode to thereby form a ceramic film on the surface of the metal.

According to the method of the invention, the anodizing treatment is performed as glow discharge and/or arc discharge is generated on the surface of the anode. Such treatment is generally called "plasma anodization", "plasma electrolytic oxidation (PEO)" or "micro arc oxidation (MAO)." Such treatment is hereinafter referred to as "PEO" treatment for descriptive purposes. A common anodizing treatment obtains a film which contains an oxide or a hydroxide of the metal substrate as its main ingredient, whereas the PEO treatment is characterized in that a film obtained by the PEO treatment contains an oxide of an ingredient of the electrolysis solution and an ingredient of the metal substrate and, due to crystallization, the obtained film is a harder oxide film than that obtained by the common anodizing treatment.

[Metal Substrate]

The metal substrate that may be used in the invention is made of aluminum, an aluminum alloy, magnesium, a magnesium alloy, titanium or a titanium alloy. In the invention, the metal substrate may be made of a wrought material or a casting material. The metal substrate is not limited to the case where it is made of a single base material. For example, the metal substrate may be a metal thin film formed by plating, vapor deposition or vapor phase epitaxy. Alternatively, a plurality of types of metal substrates may be simultaneously used or be combined together as a composite material.

[Pretreatment]

It is not particularly necessary to perform a pretreatment as the preliminary preparation for the electrolytic treatment. However, degreasing is preferably performed as required in order to remove stains, metallic powder and oil on the surface of the metal substrate. Degreasing may be appropriately performed by alkali degreasing, solvent degreasing or detergent degreasing. The surface is preferably cleaned by means such as immersion, spraying, ultrasonic treatment and wiping.

Acid pickling may also be performed as the pretreatment. The surface of the substrate may be etched as required by hydrofluoric acid, hydrochloric acid, sulfuric acid, nitric acid, oxalic acid or ferric chloride, or a combination acid thereof. In this way, the ceramic film to be formed may have further enhanced adhesion or uniformity under the following actions: further cleaning of the substrate surface, selective removal of a specified ingredient from the base material and fine roughening of the surface.

The electrolysis solution for electrolytic ceramic coating on metal according to the invention (hereinafter also referred to as the "electrolysis solution of the invention") is one which contains water, a zirconium compound, a complexing agent, and at least one member selected from the group consisting of an alkali metal ion, ammonium ion and an organic alkali, in which the zirconium compound is included at a concentration (X) in terms of zirconium of 0.0001 to 1 mol/L, in which the complexing agent is included at a concentration (Y) of 0.0001 to 0.3 mol/L, and in which a ratio of the concentration (Y) of the complexing agent to the concentration (X) in terms of zirconium (Y/X) is at least 0.01.

The electrolysis solution of the invention is one which further contains carbonate ion, in which the carbonate ion is included at a concentration (Z) of 0.0002 to 4 mol/L and in which a ratio of the concentration (Z) of the carbonate ion to the concentration (X) in terms of zirconium (Z/X) is at least 2.5. The electrolysis solution of the invention has an electrical conductivity of up to 20 S/m.

[Zirconium Compound]

The zirconium compound is not particularly limited and is preferably a water-soluble zirconium compound. The water-soluble zirconium compound enables a film with a uniform and compact structure to be formed.

In cases where the electrolysis solution contains two or more zirconium compounds, at least one of the zirconium compounds is preferably water-soluble and all the zirconium compounds are more preferably water-soluble for the same reason as described above.

The zirconium compound is not particularly limited and examples thereof include zirconium salts of organic acids such as zirconium acetate, zirconium formate, and zirconium lactate; zirconium complex salts such as zirconium ammonium carbonate, zirconium potassium carbonate, zirconium ammonium carbonate, zirconium sodium oxalate, zirconium ammonium citrate, zirconium ammonium lactate and zirconium ammonium glycolate; and zirconium hydroxide and basic zirconium carbonate. Some of them are not soluble when used singly but are soluble when used with a complexing agent, and some are only soluble in a solution in a limited pH range.

Of these, zirconium carbonate compounds are preferred in terms of the easy dissolution and stable presence in the inventive alkaline electrolysis solution, easy availability and compact structure of the resulting film. The zirconium carbonate compound is a transparent anionic polymer dissolved in the electrolysis solution by the coordination of carbonate ion to zirconium ion and is represented by general formula $[M]_n[Zr(CO_3)_x(OH)_y]_m$. M is a water-soluble cation which stably dissolves in the treatment solution, x and y usually take a value of 1 to 6, and n and m usually take a value of 1 to 10. Examples of the zirconium carbonate compound include zirconium ammonium carbonate, zirconium sodium carbonate and zirconium potassium carbonate. For example, zirconium potassium carbonate is often represented by such a simplified formula as $K_2[Zr(OH)_2(CO_3)_2]$ or $K_2[ZrO(CO_3)_2]$.

In cases where a complexing agent is separately added in the invention, even if coordinated carbonate ion ($CO_3^{-2}$) necessary for the dissolution is partly detached in the chemical formula of zirconium carbonate, hydroxyl group or carboxyl group of the complexing agent is coordinated instead and the solubility is maintained. M is preferably selected from alkali metal ions such as lithium ion, sodium ion, potassium ion, rubidium ion and cesium ion, ammonium ion and organic alkali ions.

The zirconium compound is included in the electrolysis solution at a concentration (X) in terms of zirconium of 0.0001 to 1 mol/L, preferably 0.005 to 0.2 mol/L, and more preferably 0.01 to 0.1 mol/L. At a concentration of less than 0.0001 mol/L, the content ratio of zirconium in the resulting film is reduced and the PEO film obtained cannot have excellent properties resulting from the zirconium in the invention. The content ratio of zirconium in the resulting film is increased with increasing content of the zirconium compound. However, at a zirconium content in excess of 1 mol/L, the solution is saturated and the solution stability is deteriorated. If the zirconium compound is included at a concentration (X) in terms of zirconium of 0.0001 to 1 mol/L, a uniform and compact film can be obtained while suppressing the formation of sludge by incorporating a specified amount of a complexing agent in the electrolysis solution of the invention.

[Complexing Agent]

In general, a metallic cation is easily converted into a hydroxide to precipitate in an aqueous alkali solution. Zirconium ion is also not an exception and is easily converted into zirconium hydroxide or a basic zirconium carbonate to form sludge in an aqueous alkali solution. Therefore, sufficient complexation is necessary to stably dissolve zirconium ion in an aqueous alkali solution. The electrolysis solution of the invention may further contain a complexing agent in order to stabilize the electrolysis solution.

In cases where a phosphate compound having no complexing ability is added, the phosphate compound binds to a metallic cation and easily forms an insoluble salt particularly on the alkali side and hence this addition facilitates the precipitation of zirconium phosphate. The complexing agent serves to suppress this action.

The interface between the film and the liquid phase during the PEO treatment has an ultra-high temperature exceeding 1,000° C. and is strongly alkaline or strongly acidic due to local pH variations and a situation is encountered in which ion cannot dissolve in the electrolysis solution. The interface between the member to be treated and the electrolysis solution during the PEO treatment is thus extremely unstable and easily forms sludge. Unexpected formation of sludge changes the composition of the solution, which consequently changes the composition of the resulting ceramic film. The sludge generated at the interface easily enters the PEO film in this form and therefore also causes defects such as roughening of the surface of the resulting ceramic film.

As described above, the PEO treatment has a heavy load on the electrolysis solution and therefore the electrolysis solution must be of a type which is resistant to formation of sludge and sufficiently keeps the pH so that it may withstand repeated loads from an industrial viewpoint. The electrolysis solution of the invention contains a specific amount of the complexing agent and therefore can suppress the formation of sludge and withstand repeated load from an industrial viewpoint.

The complexing agent is not particularly limited as long as it is a compound capable of forming a zirconium ion-containing complex. In the practice of the invention, however, the complexing agent does not encompass carbonates and phosphate compounds having low complexing ability.

Examples of the complexing agent include acetic acid, glycolic acid, gluconic acid, propionic acid, citric acid, adipic acid, lactic acid, ascorbic acid, malic acid, tartaric acid, oxalic acid, ethylenediaminetetraacetic acid, nitrilotriacetic acid, diethylenetriaminepentaacetic acid, hydroxyethylethylenediaminetriacetic acid, methylglycinediacetic acid and salts thereof. Of these, compounds having both of hydroxyl group and carboxyl group, and particularly tartaric acid and citric acid are preferred because they easily bind to zirconium to form a cyclic complex and have a very strong stabilizing action on the electrolysis solution. The addition of these compounds brings about the pH buffering effect and therefore the solution pH stabilizing effect.

The concentration (Y) of the complexing agent in the electrolysis solution of the invention is from 0.0001 to 0.3 mol/L, preferably from 0.0005 to 0.1 mol/L, and more preferably 0.001 to 0.03 mol/L. At a concentration of less than 0.0001 mol/L, the electrolysis solution cannot be fully stabilized, whereas at a concentration in excess of 0.3 mol/L, the effect of the complexing agent as the stabilizer is saturated and is disadvantageous in terms of cost and the electrical conductivity may exceed a reasonable value by the excessive addition.

The electrolysis solution of the invention further stabilizes at a larger ratio of the concentration (Y) of the complexing agent (mol/L) to the concentration (X) in terms of zirconium (mol/L) (Y/X). The electrolysis solution of the invention is used at a pH of 7 to 14. At a pH within this range, the ratio Y/X is at least 0.01, preferably at least 0.05 and more preferably at least 0.1. The ratio Y/X more preferably has a larger value in a solution which is strongly alkaline. The ratio Y/X is preferably at least 0.5 at a pH above 11 and at least 1 at a pH above 12. A ratio Y/X of at least 0.1 enables the electrolysis solution to be fully stabilized while suppressing the formation of sludge. The electrolysis solution can be stored for an extended period of time, the durability against repeated loads can be increased and the solution exchange frequency can be reduced and therefore the electrolysis solution enables efficient film formation and is advantageous in terms of cost.

The ratio Y/X has no particular upper limit but is preferably up to 100 and more preferably up to 50 in terms of cost because the complexing agent is comparatively expensive.

[Counter Ion]

The electrolysis solution of the invention contains at least one cation selected from the group consisting of an alkali metal ion, ammonium ion and an organic alkali.

These cations are mainly included as counter ions for the added zirconium compound, complexing agent and carbonate compound, and pH adjuster for adjusting the pH in the alkaline range. They have very high ionizing properties and therefore assist the stability of the solution without causing hydroxide precipitation in the electrolysis solution of the invention.

[Carbonate Ion]

The electrolysis solution of the invention further contains a carbonate and its content in terms of the carbonate ion concentration (Z) in the electrolysis solution is preferably 0.0002 to 4 mol/L, more preferably 0.01 to 2 mol/L and even more preferably 0.1 to 0.5 mol/L. A carbonate ion concentration (Z) in the electrolysis solution within the above-defined range improves the stability of the electrolysis solution, effectively suppresses the formation of sludge and facilitates the film formation.

The carbonate is inexpensive and is one of rare anionic compounds used for the conductivity adjuster and having few adverse effects on the film properties and therefore may be advantageously used to adjust the electrical conductivity in a desired range. In addition, carbonate ions get together around the interface of the anodic substrate as an anion during the anodization and forms an insulating layer which is a thin resistive film and therefore also serves as an effective film forming aid. The carbonate ion hardly enters the film presumably because it is decomposed at high temperatures during the film formation and therefore the adverse effects of its addition or the amount of addition on the composition of the resulting PEO film is vanishingly small. In addition, the carbonate ion simultaneously has the function of the pH adjuster because it is a salt of a weak acid.

In addition, when the carbonate ion content is excessive with respect to the zirconium content, the dissociation of the complex does not easily occur and therefore the electrolysis solution of the invention is further stabilized. Carbonate ion is cheaper than the complexing agent made of an organic compound and therefore it is preferred to use the complexing agent and carbonate ion in a balanced manner for the stability of the electrolysis solution. In the electrolysis solution of the invention, the ratio of the carbonate ion concentration (Z) to the concentration (X) in terms of zirconium (Z/X) is preferably at least 2.5, more preferably at least 3.5 and even more preferably at least 4. At a ratio Z/X of at least 2.5, the stabilizing effect is considerably increased and the amount of complexing agent used can be reduced. In addition, the formation of sludge can be suppressed. The upper limit is not particularly limited as long as an excessive addition of carbonate ion does not cause the electrical conductivity to exceed a reasonable range. By controlling the complexing agent and carbonate ion so as to fall within the ranges defined in the invention, the resulting electrolysis solution is inexpensive, has high solution stability and has sufficient film formability.

In consideration of the reasonable electrical conductivity of the electrolysis solution, the upper limit of the ratio Z/X is preferably up to 50 and more preferably up to 25.

Examples of the carbonate include those which are soluble in aqueous alkali solutions, as exemplified by lithium carbonate, lithium hydrogen carbonate, sodium carbonate, sodium hydrogen carbonate, potassium carbonate, potassium hydrogen carbonate, rubidium carbonate, rubidium hydrogen carbonate, cesium carbonate, cesium hydrogen carbonate, ammonium carbonate and ammonium hydrogen carbonate. Carbonated water in which carbonic acid is dissolved in water may also be used. These may be used singly or in combination of two or more.

Of these, at least one selected from the group consisting of potassium carbonate, potassium hydrogen carbonate, sodium carbonate and sodium hydrogen carbonate is more preferred because they are easily available and inexpensive, the solubility in the electrolysis solution of the invention is high, and they can exhibit higher effects on the stability of the electrolysis solution, promotion of the film formation and adjustment of the electrical conductivity.

[Poorly Soluble Particles]

The electrolysis solution of the invention may contain poorly soluble particles of at least one member selected from the group consisting of an oxide, a hydroxide, a phosphate compound, a nitride and a carbide. Inclusion of the poorly soluble particles enables the treatment at a higher film deposition rate and hence in a shorter period of time. These poorly soluble particles each have a surface more or less negatively charged in the treatment solution of the invention and are therefore considered to be dispersed in the film in the form of particles during the deposition of the PEO film to be anodized and to be codeposited. In addition, part of the uppermost surfaces of the particles are more or less decomposed according to the plasma state during the film formation and therefore part of the constituent elements of the particles are also the constituent elements of the film which is the matrix supporting the particles. In addition, in cases where the particle size is very small, all the particles may be plasma-decomposed and incorporated not in the form of particles but simply as constituent elements of the film.

An advantage of the inclusion of the poorly soluble particles is that these particles hardly affect the electrical conductivity of the electrolysis solution. In other words, in cases where the constituent elements of the film are all added to the electrolysis solution in the form of ions, the electrical conductivity may often considerably exceed the target value. On the other hand, in cases where the poorly soluble particles are used, the electrical conductivity is hardly affected and therefore the above problem does not occur. There is another advantage that ion species which are not stably soluble depending on the pH of the electrolysis solution used can be added in the form of poorly soluble particles.

The poorly soluble particles preferably have a particle size of 1 μm or less, more preferably 0.3 μm or less, and even more preferably 0.1 μm or less. A particle size within the above-defined range facilitates the dispersion of the particles in the electrolysis solution and can avoid the roughening of the uppermost surface when the particles were codeposited and incorporated in the PEO film.

The content of the poorly soluble particles in the electrolysis solution is not particularly limited and is preferably from 0.01 to 100 g/L and more preferably from 0.1 to 10 g/L because the film deposition rate is increased to enable the treatment to be performed in a shorter period of time. The content is even more preferably from 0.5 to 5 g/L.

Exemplary poorly soluble particles that may be dispersed in the electrolysis solution of the invention include oxides such as zirconium oxide (zirconia), titanium oxide, iron oxide, tin oxide, silicon oxide (e.g., silica sol), cerium oxide, $Al_2O_3$, $CrO_3$, MgO, and $Y_2O_3$; hydroxides such as zirconium hydroxide, titanium hydroxide and magnesium hydroxide; potassium carbonate; phosphate compounds such as zinc phosphate, aluminum phosphate, calcium phosphate, manganese phosphate, iron phosphate, zirconium phosphate, titanium phosphate, and magnesium phosphate; nitrides such as $Si_3N_4$, AlN, BN and TiN; carbides such as graphite, VC, WC, TiC, SiC, $Cr_3C_2$, ZrC, $B_4C$, and TaC. These particles may be added in the form of slurry or sol, or added in the form of powder and dispersed in the solution.

For example in the case of using zirconium oxide particles with a particles size of 0.05 μm or less, the particles are fully plasma-decomposed to serve as the zirconium element making up the matrix of the PEO film made of zirconium in the invention. In the case of using silica sol which is inexpensive and easily available, the adverse effect on the roughness of the surface of the ceramic film is also small because of sufficiently small particle size and the poorly soluble particles are useful as a bulking agent of the PEO film. The PEO film made of zirconium oxide in the invention is a good matrix supporting the codeposited particles and therefore the hardness and sliding properties can be adjusted according to the particles used.

[Cation Added]

A preferred embodiment of the electrolysis solution of the invention further includes at least one metallic ion selected from the group consisting of silicon, titanium, aluminum, niobium, yttrium, magnesium, copper, zinc, scandium and cerium at a concentration in terms of elemental metal of 0.0001 to 1 mol/L.

It is considered that inclusion of any of the metals in the form of an ion and/or an oxide enables the adjustment of the film appearance depending on the intended purpose and contributes to improving the mechanical properties. For example, the addition of silicon, zinc or aluminum has the effect of increasing the hardness of the film and the addition of titanium or copper has the effect of turning the film brown or black. When the electrolysis solution contains yttrium, partially stabilized zirconium is formed, which may improve the mechanical properties of the film.

In order that the addition of the metal may be fully effective, the metal in the form of an ion and/or an oxide is preferably included at a concentration in terms of elemental metal of 0.0001 to 1 mol/L, more preferably 0.005 to 0.20 mol/L and even more preferably 0.01 to 0.10 mol/L.

Silicon is derived from, for example, sodium silicate, potassium silicate, lithium silicate, lithium sodium silicate, lithium potassium silicate, γ-aminopropyltrimethoxysilane, or γ-aminopropyltriethoxysilane. Titanium is derived from, for example, various organic complex titanium compounds and various organic complex titanate compounds such as peroxotitanate compound, titanium lactate, titanium triethanol aminate, titanium tartrate, potassium tartrate titanate, and potassium oxalate titanate. Aluminum is derived from, for example, aluminum hydroxide, aluminum carbonate, aluminate compounds such as potassium aluminate and sodium aluminate, and various organic complex aluminum compounds such as aluminum tartrate and aluminum citrate. Niobium is derived from, for example, various organic complex niobium compounds and various organic complex niobate compounds such as niobium tartrate, niobium citrate, and potassium oxalate niobate. Yttrium is derived from, for example, various organic complex yttrium compounds such as yttrium tartrate, yttrium citrate, yttrium lactate, and yttrium acetylacetonate. Magnesium is derived from, for example, various organic complex magnesium compounds such as magnesium carbonate, magnesium citrate and magnesium hydroxide. Copper is derived from, for example, various organic complex copper compounds such as copper hydroxide, copper carbonate, copper tartrate and copper citrate. Zinc is derived from, for example, various organic complex zinc compounds such as zinc hydroxide, zinc carbonate, zinc biphosphate, zinc tartrate and zinc citrate. Scandium is derived from, for example, various organic complex scandium compounds such as scandium carbonate, scandium biphosphate and scandium citrate. Cerium is derived from, for example, various organic complex cerium compounds such as cerium hydroxide, cerium acetate, cerium carbonate, cerium tartrate and cerium citrate.

[Electrical Conductivity]

The electrolysis solution of the invention preferably has an electrical conductivity during the treatment of 0.2 to 20 S/m, more preferably 0.5 to 10 S/m and even more preferably 1 to 5 S/m. An electrical conductivity within the above-defined range enables the film deposition rate to be suitably increased while suppressing the abnormal growth of the film.

The following description is made assuming that the electrical conductivity is adjusted only based on the carbonate ion concentration in the composition of the solution. Under the constant voltage treatment conditions, the current flows more smoothly at a higher electrical conductivity of the electrolysis solution. The film thickness correlates with the total charge amount and therefore the more smoothly the current flows, the higher the film growth rate is. At an electrical conductivity in excess of 1 S/m, the solution resistance is so small that the amount of voltage decreased in the electrolysis solution may be disregard. In other words, a smoother current flow owing to an increase in electrical conductivity shows a decrease in the resistance of the contact between the member to be treated and the solution surface via the plasma state. The higher the electrical conductivity is, the more the amount per pulse of constituent elements of the film supplied from the plasma atmosphere is increased. If the supply rate exceeds a certain threshold, it becomes difficult to cool the film appropriately and the resulting film has more defects. The higher the electrical conductivity is, the more the amount of film growth per pulse and the amount of heat generation from the film are increased. In order to suppress heat generation at a higher electrical conductivity of the electrolysis solution so as to prevent abnormal growth, it is preferred to take such measures as reducing the duty ratio during the treatment, shortening the pulse width and prolonging the pulse off period, or reducing the treatment voltage and the treatment current density.

In order to reduce the amount of electricity in terms of cost, a treatment at a lower voltage is more advantageous and in this case the electrolysis solution should have a high electrical conductivity suitable to the low-voltage treatment. However, in the case of the low-voltage treatment, a slight change in the voltage may change the film deposition rate, reduce the threshold for abnormal growth or otherwise narrow the control ranges during the treatment and it is necessary to individually determine a proper value.

On the other hand, the electrolysis solution with a low electrical conductivity has the merit that the proper range of the frequency and particularly that of the duty ratio which are capable of a high-voltage treatment are enlarged. The treatment at a higher voltage is disadvantageous in terms of electricity costs but the activation energy in the initial film formation is easily exceeded and as a result the electrolysis solution with a low electrical conductivity is advantageous in the improvement of the throwing power.

(Others)

A preferred embodiment of the electrolysis solution of the invention further contains a water-soluble phosphate compound at a concentration in terms of phosphorus of 0.001 to 1 mol/L. Various phosphate ions highly adsorb on the substrate metal, reduce the activation energy for forming the initial film and serve as more effective film forming aids than carbonate ion. As a result, the phosphate ions have the effect of reducing the thresholds of the treatment voltage and treatment current necessary to form the film particularly in the low-voltage or low-current treatment, and therefore effectively contribute to improving the film-forming rate and the throwing power.

For example, ADC12 material is a typical die casting aluminum alloy to which silicon is added as an alloying ingredient in order to increase the mechanical strength. However, addition of a larger amount of silicon easily hinders the start of the formation of the ceramic film even if a sufficient amount of current is flowed. In this regard, inclusion of a sufficient amount of film-forming aid in the electrolysis solution enables the formation of a ceramic film on the surface of a substrate metal having a small electric resistance to be started. Therefore, the electrolysis solution preferably contains a sufficient amount of film-forming aid particularly in the case of an aluminum alloy containing a large amount of silicon, and it is particularly effective to include a phosphate compound. As described above, the electrolysis solution preferably contains a sufficient amount of film-forming aid particularly in the case of an aluminum alloy containing a large amount of silicon, and it is effective to add carbonate ion and further a phosphate compound.

In addition, the phosphate ion has a buffer action to keep the pH in an alkaline range and therefore the phosphate compound is also advantageous in that the pH of the electrolysis solution does not easily change and the pH control is easy.

Examples of the water-soluble phosphate compound that may be used include orthophosphoric acid ($H_3PO_4$), chain polyphosphoric acids ($H_{n+2}P_nO_{3n+1}$) obtained by dehydration condensation such as pyrophosphoric acid ($H_4P_2O_7$) and tripolyphosphoric acid ($H_5P_3O_{10}$), cyclic metaphosphoric acid ($H_nP_nO_{3n}$), organic phosphonic acid and salts thereof (n is a natural number).

Of these, the condensed phosphoric acids such as pyrophosphoric acid and tripolyphosphoric acid and salts thereof are more preferred because they slightly have a chelating ability and therefore the effect of stably retaining the phosphate compound in the electrolysis solution without depositing sludge from zirconium can also be expected. However, when a treatment load is applied under severe conditions or the pH is kept at a value above 10, the solution stabilizing action is not sufficient and therefore the combined use with the complexing agent selected from the foregoing organic acids is necessary.

The phosphate compound is preferably included in the electrolysis solution of the invention at a concentration in terms of phosphorus of 0.001 to 1 mol/L, more preferably 0.005 to 0.5 mol/L, and even more preferably 0.01 to 0.2 mol/L. At a concentration of less than 0.001 mol/L, the phosphorus compound hardly has the effect of the film-forming aid. Addition at a concentration in excess of 1 mol/L is disadvantageous in terms of cost due to the saturation of the addition effect and considerably affects the electrical conductivity, so that the electrical conductivity may not fall within the target range.

The electrolysis solution of the invention may further contain a peroxo compound such as hydrogen peroxide solution. The content of the peroxo compound in the electrolysis solution is preferably from 0.001 to 1 mol/L. The peroxo compound has thus the action of more strongly oxidizing the film and an improved compactness of the film, an improved smoothness and a higher hardness can be expected.

The pH of the electrolysis solution of the invention is not particularly limited. However, in order to obtain a hard and compact film with good adhesion, the pH preferably takes a value at which the metal substrate to be treated is passivated to be rendered electrochemically inactive.

Therefore, in cases where the substrate to be treated is made of aluminum or an aluminum alloy, the electrolysis solution preferably has a pH of 7 to 12 and more preferably 8 to 11. At a pH within this range, the dissolution of the metal substrate can be suppressed during the immersion before starting the treatment. In addition, the film formed has higher smoothness and fewer defects.

It is preferred to add fluorine atom to the electrolysis solution because the passivation area of the aluminum member is enlarged to enable the treatment to be performed in a wider pH range. However, the electrolysis solution is preferably free from fluorine atom from the working and environmental aspects because fluorine atom is also incorporated into the film.

In cases where the substrate to be treated is made of magnesium or a magnesium alloy, the electrolysis solution of the invention preferably has a pH of 9 to 14 and more preferably 11 to 13. At a pH within this range, the dissolution of the metal substrate can be suppressed during the immersion before starting the treatment. In addition, the film formed has higher smoothness and fewer defects.

As in the case of using the aluminum material, fluorine atom is preferably present in the electrolysis solution because the magnesium passivation area is enlarged to enable the treatment to be performed in a wider pH range. However, the electrolysis solution is preferably free from fluorine atom from the working and environmental aspects because fluorine atom is also incorporated into the film.

Titanium has a larger passivation area than aluminum and magnesium, and therefore can be treated without particular limitation in a pH range in which the electrolysis solution is stable. Therefore, in cases where the substrate to be treated is made of titanium or a titanium alloy, the electrolysis solution of the invention preferably has a pH of 2 to 14. However, in cases where the electrolysis solution contains carbonate ion in the invention, the electrolysis solution must be alkaline and therefore more preferably has a pH of 7 to 14.

An exemplary method that may be advantageously used to obtain the alkaline electrolysis solution as described above involves adjusting the pH with alkali metal hydroxides such as potassium hydroxide, sodium hydroxide, lithium hydroxide, cesium hydroxide and rubidium hydroxide; and organic amines such as ammonia, tetraalkylammonium hydroxide (e.g., tetramethylammonium hydroxide), trimethyl(2-hydroxyethyl)ammonium hydroxide, trimethylamine, alkanolamine and ethylenediamine.

[Treatment Temperature]

The temperature of the electrolysis solution of the invention is not particularly limited and the treatment is usually performed at a temperature of 0 to 60° C. The temperature is more preferably from 5 to 50° C. and even more preferably from 10 to 40° C. A temperature within the above-defined range enables high economic efficiency while suppressing the dissolution of the metal used as the anode. This treatment increases the solution temperature. The electrical conductivity of the electrolysis solution is also increased with increasing temperature. Therefore, if the electrical conductivity may depart from the reasonable range under the treatment load, it is preferred to appropriately control the solution temperature with a cooler so as to keep the temperature within the set range.

[Solvent]

The method of manufacturing the electrolysis solution of the invention is not particularly limited and the electrolysis solution may be obtained by dissolving or dispersing the respective ingredients in a solvent. The solvent is not particularly limited and is preferably water. An organic solvent which is compatible with water may be appropriately incorporated in order to adjust the electrical conductivity and ensure the antifoaming properties. Exemplary solvents that may be appropriately used include methanol, ethanol, propanol, butanol, acetone, methyl acetate and ethyl acetate.

The electrolysis solution of the invention which contains no poorly soluble particles is preferably transparent as a whole, and the transparent electrolysis solution is obtained by appropriately selecting a combination of ingredients and mixing the ingredients in proper amounts. When the electrolysis solution is transparent, the surface of the metal substrate during the anodizing step can be appropriately observed and the resulting oxide film has good appearance. The electrolysis solution which contains poorly soluble particles is suspended except the case in which the amount of poorly soluble particles added is small.

[Anodization]

In the inventive method of electrolytic ceramic coating on metal, any of the foregoing metals is used as the anode in the electrolysis solution and a voltage waveform at least part of which is a positive voltage portion is used to perform the anodizing treatment as glow discharge and/or arc discharge (spark discharge) is generated on the surface of the anode. The surface of the metal serving as the anode is visually checked during the treatment to see the discharge state. The discharge state can be recognized as such discharge colors as light green, bluish white, pink, yellow and red.

Glow discharge is a phenomenon in which the whole surface is surrounded by weak continuous light, and arc discharge is a phenomenon in which sparks are generated intermittently and locally. However, it is very difficult to precisely distinguish them by a visual observation. Both of glow discharge and arc discharge may take place simultaneously or only one of them may take place. The arc (spark) temperature is said to be at least 1,000° C. and the temperature in this range enables zirconium in the electrolysis solution to be crystallized and deposited on the substrate metal.

The process of anodizing treatment is not particularly limited and examples thereof include DC electrolysis, pulse electrolysis and bipolar electrolysis. Of these, since the anodizing treatment is performed at a comparatively high voltage, pulse electrolysis having intermittent periods is preferred, monopolar electrolysis only having positive application, and bipolar electrolysis using a mixed application treatment including positive application and negative application are more preferred.

In principle, the film grows upon the application of a positive voltage and therefore the anodizing treatment using the PEO treatment is performed with a voltage waveform at least part of which is a positive voltage portion. In a preferred embodiment of the method of the invention, the anodizing treatment is performed by only applying a positive voltage (monopolar treatment). In the following description, the direction of current flowing upon the application of a positive voltage is referred to as "positive direction of the current."

On the other hand, it is presumed that no film grows upon the application in the negative direction. In the method of the invention, however, for the reasons to be described later, at least part of the anodizing treatment is preferably performed by bipolar electrolysis including application of a negative voltage.

Bipolar electrolysis is an electrolysis process using a voltage waveform which includes positive voltage portions and negative voltage portions. The positive/negative application improves the adhesion and the smoothness of the film and the film-forming rate. The direction of electric field in the film is alternately switched between the positive direction and the negative direction by bipolar electrolysis and as a result specific ingredients within the film are prevented from being concentrated and factors that may cause the adhesion failure due to the concentrated interface can be excluded. In particular, the phosphate compound is easily concentrated at the interface to inhibit the adhesion of the ceramic film. Therefore, bipolar electrolysis by means of positive/negative application is desirably employed in the case of using a phosphate compound-containing electrolysis solution.

The positive/negative application causes an agitating action of the electrolysis solution in the vicinity of the PEO film during the film formation, which has the cooling effect, thus causing the action of improving the smoothness and the film-forming rate. However, the negative application does not directly contribute to the film formation but increases the electricity cost. In addition, excessive application causes the cathode dissolution of the substrate and delamination of the film due to hydrogen generated at the interface between the substrate and the film and therefore the application period is desirably as short as possible within the effective range.

[Waveform]

In the monopolar electrolysis of the invention, a positive application is repeatedly performed to the member to be treated: positive→positive→positive→(thereafter repeated in the same manner). Each of the arrows refers to a proper pulse off period in which no application is made. The voltage or the current is controlled to draw any of various application waveforms during the positive application. In the practice of the invention, the waveform used for the application is not particularly limited and examples thereof include square waveform (rectangular waveform), sinusoidal waveform, trapezoidal waveform, triangular waveform and saw-tooth waveform. Hereinafter, the waveform control in which the voltage is controlled so as to draw a desired waveform is called "constant voltage control" and that in which the current is controlled so as to draw a desired waveform is called "constant current control." The minimum waveform unit is [positive→], which forms one wavelength.

In the bipolar electrolysis of the invention, a positive voltage is combined with a negative voltage to form a set and the voltage is usually applied on the set basis as follows: [positive→negative]→[positive→negative]→(thereafter repeated in the same manner). As in the monopolar electrolysis, each of the arrows (→) refers to a proper pulse off period. It is preferred to individually perform constant voltage control or constant current control on both of the positive and negative sides irrespective of the waveform. The minimum waveform unit is [positive→negative→], which forms one wavelength.

[Current, Voltage]

The constant voltage process of the invention is a process in which a section exists where a treatment is made under the voltage control according to any waveform over a predetermined treatment time (e.g., at least 60 seconds) and for example, a combination of a plurality of treatments at different constant voltages as in the case of stepwise changes is also included. In the constant voltage process, the film formed generally has good smoothness but the resistance is increased with the growth of the film and therefore the current is decreased to slow down the growth of the film.

The constant current process is a process in which a section exists where a treatment is made under the current control according to any waveform over a predetermined treatment time (e.g., at least 60 seconds) and for example, a combination of a plurality of treatments at different constant currents as in the case of stepwise changes is also included. The constant current process facilitates the control of the amount of deposited film which correlates with the amount of charges and is likely to form a comparatively thick film. The constant current process very often consumes less electric power than the constant voltage process, but the film surface is more likely to be roughened than in the constant voltage process.

[Frequency]

The frequency during the treatment is preferably from 5 to 20,000 Hz, more preferably from 10 to 5,000 Hz and even more preferably from 30 to 1,000 Hz. The treatment at a frequency within the above-defined range enables a highly smooth and compact film to be obtained. At a treatment frequency of less than 5 Hz, the energization time in one positive application cycle (hereinafter referred to as "pulse width") is prolonged to form the film within a reasonable treatment time, resulting in excessive heat generation in the film, which may lead to an abnormal growth of the film to be formed.

At a treatment frequency in excess of 20,000 Hz, it is difficult to fully ensure the effective pulse off period and the film which generated heat is not sufficiently cooled to easily cause an abnormal growth of the film.

[Duty Ratio]

In the practice of the invention, the duty ratio on the positive side (T1) is preferably from 0.02 to 0.5, more preferably from 0.05 to 0.3 and even more preferably from 0.1 to 0.2. The duty ratio on the negative side (T2) in the bipolar treatment is preferably from 0 to 0.5, more preferably from 0.05 to 0.3 and even more preferably from 0.1 to 0.2. The ratio of the non-application time per unit time, that is, the duty ratio of the pulse off period (T3) is preferably from 0.35 to 0.95, more preferably from 0.55 to 0.90 and even more preferably from 0.70 and 0.85.

It is preferred for these parameters to simultaneously meet the following formulas:

$$0 \leq T2/T1 \leq 10$$

$$0.5 \leq T3/(T1+T2) \leq 20$$

It is more preferred for these parameters to simultaneously meet the following formulas:

$$0.1 \leq T2/T1 \leq 3$$

$$2 \leq T3/(T1+T2) \leq 15$$

[Monopolar and Bipolar Treatments]

In the method of the invention, (monopolar) treatment regions in which the voltage applied is only positive and (bipolar) treatment regions in which positive/negative application is made may be mixed. For example, in the case of forming a film with a uniform thickness, the monopolar treatment may be more advantageous in terms of electricity costs. In such a case, the advantages of the bipolar electrolysis can also be obtained by incorporating bipolar regions in part of the treatment. Particularly in cases where the bipolar electrolysis is expected to have the action of homogenizing the film, it is preferred to perform the monopolar treatment in the first half and the bipolar treatment in the second half.

In the bipolar electrolysis, a positive voltage is combined with a negative voltage to form a set of waveform and the set is repeated as follows: [positive→negative]→[positive→negative]→(thereafter repeated in the same manner). In the method of the invention, however, the positive side may not have a one-to-one relationship with the negative side. Various combinations may be selected as exemplified by ([positive→negative]→[positive])→([positive→negative]→[positive])→(thereafter repeated in the same manner), as long as the situation in which a negative voltage is only applied over a prolonged period of time is avoided.

In the method of the invention, it is preferred to provide a pulse off period between positive or negative adjacent pulses in terms of the cooling effect and uniform concentration owing to the agitating action of the electrolysis solution. The negative application period also has the cooling effect but the pulse off period has a stronger cooling effect. Numerous discharge points exist on the film during the film formation by means of positive application, but provision of the pulse off periods enables discharge points that were once generated to be transferred to other points and is effective to form a more uniform and compact film.

The length of the pulse off period is not particularly limited and is set as appropriate for the electrolysis solution conditions and treatment conditions. However, at an excessively long pulse off period, the treatment time and hence the total application period are prolonged, which reduces the working efficiency. On the other hand, at an excessively short pulse off period, the cooling effect does not work and heat is kept in the electrolysis solution, which may lead to abnormal growth of the film, thus causing roughening, poor appearance, scaly appearance or powdery appearance.

In the method of the invention, the process used to obtain the cooling effect instead of prolonging the pulse off period involves shortening the positive application time per wavelength (pulse width) to reduce the amount of heat generation per pulse. More specifically, it is preferred to decrease the duty ratio (ratio of application time per unit time) without changing the frequency or increasing the frequency without changing the duty ratio.

However, a decreased duty ratio lowers the film-forming rate per unit time to deteriorate the processing productivity. If the frequency is increased without changing the duty ratio, the pulse width in one application cycle is shortened to reduce the amount of heat generated on the positive application side in the one cycle, and the subsequent pulse off period is also shortened to reduce the cooling effect. Accordingly, the duty ratio and the frequency are preferably adjusted within reasonable ranges. As long as these parameters are within the reasonable ranges, if the duty ratio is the same, the total application time is the same after the mere change of the frequency and hence the film-forming rate is substantially the same.

In the method of the invention, the bipolar treatment may be performed by the constant voltage process or the constant current process on both of the positive and negative sides.

In a preferred embodiment, the positive side is controlled by the constant current process and the negative side is controlled by the constant voltage process. In another preferred embodiment, the positive side is controlled by the constant voltage process and the negative side is controlled by the constant current process. Advantages of both the processes can be enjoyed by using the constant voltage process and the constant current process in combination. That is, according to this method, it is comparatively easy to control the amount of film deposition and to increase the film thickness, and the power consumption can be suppressed to obtain a highly smooth film.

In a preferred embodiment of the method of the invention, the constant voltage process is followed by the constant current process. The constant voltage process has the merit that the film surface is not readily roughened but the film is hard to grow with the elapse of the treatment time. However, the film can have specified smoothness and thickness by adopting the constant current process in the second half of the treatment. When the constant current process is used from the beginning, there is a case in which a resistant film is not readily formed on the member to be treated depending on the material used, and the voltage is not readily increased, resulting in difficulty in film formation. This embodiment is effective in such a case.

Based on the characteristics of zirconium oxide as the n-type semiconductor, the film obtained by the method of the invention has such a rectification property that the current easily flows in the negative direction but not easily in the positive direction. Therefore, during the positive application, the current density value is preferably controlled within a reasonable range irrespective of whether the treatment is performed by the constant voltage process or the constant current process. In the negative application, the voltage value applied is preferably controlled within a reasonable range irrespective of whether the treatment is performed by the constant voltage process or the constant current process.

[Current Density during Positive Application]

In the method of the invention, the average current density during the positive application is preferably from 0.5 to 40 $A/dm^2$, more preferably from 1 to 20 $A/dm^2$ and even more preferably from 2 to 10 $A/dm^2$. At an average current density within the above-defined range, a spark discharge is easily generated and a good film is formed. An average current density of less than 0.5 $A/dm^2$ excessively reduces the film growth rate and is disadvantageous in terms of productivity, whereas an average current density in excess of 40 $A/dm^2$ makes it hard to sufficiently cool the film and abnormal growth is more likely to occur. When the constant current process is used in the application in the positive direction, the average current density should be fixed within the foregoing range, and when the constant voltage process is used, the peak value of the varying current should fall within the foregoing range.

When the current density during the positive application takes a value defined in the invention, the voltage value applied is usually from 150 to 650 V. In a preferred embodiment, the treatment is performed so that the electrical conductivity of the electrolysis solution is increased and the positive voltage is less than 300 V. In this case, the power consumption can be suppressed, which is economically advantageous.

[Voltage Value During Negative Application]

In the bipolar treatment, the voltage value is preferably controlled within a reasonable range during the negative application irrespective of whether the treatment is performed by the constant voltage process or the constant current process. The peak absolute value is preferably from 0 to 350 V, more preferably from 40 to 200 V and even more preferably from 80 to 150V. When the constant voltage process is used in the application in the negative direction, the voltage should be fixed within the foregoing range, and when the constant current process is used, the varying voltage should take a value within the foregoing range.

In the method of the invention, a higher electrical conductivity of the electrolysis solution enables a treatment at a lower voltage. However, a solution with a higher electrical conductivity is more likely to cause abnormal growth of the film during the treatment at a high voltage unless the duty ratio during the positive application is reduced. On the other hand, a solution with a lower electrical conductivity enables a treatment at a higher voltage under the positive application at a comparatively large duty ratio. However, a low voltage requires a further increase in the duty ratio in the positive application, which may hinder the film growth.

In both the cases, the average current density during the positive application is preferably in a range of 0.5 to 40 $A/dm^2$ irrespective of whether the control is made by the constant voltage process or the constant current process.

Particularly during the positive application in the constant voltage process, the film resistance is small until the growth of a film to a thickness of 0.5 μm from just after the start of the treatment when no film is formed, and therefore an overcurrent exceeding 40 $A/dm^2$ may flow over a few seconds. However, the current is irrelevant to the abnormal growth of the film and therefore a good film is formed by controlling the current density on the positive side during the growth of the film with a thickness exceeding 0.5 μm within the range of the invention.

For the sake of equipment, a slow up period when application is gradually increased may be provided especially in the initial treatment stage of the constant current process or constant voltage process in order to prevent high current from flowing abruptly. In order to reduce the mechanical load on the equipment and for the sake of safety, a slow down period when application is gradually decreased to the end may be provided in the second half of the treatment if necessary. The main role of both the periods is not the film formation and therefore the current value or voltage value may depart from the range defined in the invention.

[Solution Temperature, Treatment Time]

The electrolysis solution may also be cooled to adjust its temperature within the foregoing range. In a preferred embodiment of the invention, the electrical conductivity is kept substantially constant by controlling the temperature of the electrolysis solution within a certain range. A good and homogeneous film can be thus formed under the control.

The electrolysis time is not particularly limited and can be appropriately selected so that the film may have a desired thickness. In general, the electrolysis time is preferably from 1 to 90 minutes, more preferably from 3 to 30 minutes, and even more preferably from 5 to 15 minutes.

[Electrolysis Apparatus]

The electrolysis apparatus that may be used in electrolytic treatment is not particularly limited and for example a conventionally known electrolysis apparatus may be used. The temperature of the electrolysis solution in the electrolytic bath is preferably kept constant by appropriately and sufficiently cooling and agitating the electrolysis solution. In order to form a good and uniform film particularly on a member of a complex shape having holes and grooves, it is effective to suppress an increase in the local temperature of the electrolysis solution within the electrolytic bath with sufficient agitation.

The material of the counter electrode that may be used in the electrolytic treatment of the invention is not particularly limited and various materials such as stainless steel materials, graphite materials, titanium materials and platinum materials may be used. In the electrolytic treatment for forming a highly resistant film, in principle, the throwing power during the treatment is good and the electrolysis solution also has a sufficient electrical conductivity. Accordingly, the cylindrical periphery, back surface, holes and fine grooves of the member to be treated are coated with a good film having substantially the same thickness as that of the film formed on the front surface of the member directly facing the counter electrode irrespective of the shape of the counter electrode, its arrangement, the arrangement distance and the area ratio between the counter electrode and the member to be treated.

In order to form a more uniform film with few differences in film thickness from position to position, it is preferred to appropriately dispose the counter electrode. For example, in the case of a hole, a central electrode which has a smaller diameter than that of the hole is inserted; in the case of the periphery of a cylinder, a cylindrical counter electrode is disposed so as to cover the periphery of the cylinder. In this case, it is preferred to appropriately select a shape which does not hinder the agitation of the solution and to perforate a plate-shaped counter electrode with holes to form a mesh-like electrode. The area ratio of the counter electrode to the member to be treated may have an arbitrary value in a range of 0.01 to 1,000 depending on the situation.

[Film]

In the practice of the invention, a ceramic film is formed on the surface of a metal substrate by performing the foregoing anodizing treatment. The mechanism by which a ceramic film is formed through spark discharge anodization is not definitely known but it is presumed that, during the formation of an oxide film on the metal substrate by the electrolytic treatment, the ingredients of the solution are also incorporated by the plasma atmosphere to form the film, as a result of which zirconium in the electrolysis solution is crystallized in the form of zirconium oxide and is incorporated into the film. In other words, in the invention, a complex film of the oxide of the metal used for the anode and the zirconium oxide is formed. In particular the soluble zirconium compound of the invention is finely and uniformly dispersed when incorporated into the film.

In order to obtain a film having good smoothness, adhesion, flexibility and sliding properties, the ceramic film preferably contains zirconium in an amount of 5 to 70 wt %, more preferably 10 to 50% and even more preferably 15 to 40%. The zirconium content may be measured by, for example, X-ray microanalysis (EPMA) or energy dispersive X-ray spectrometry (EDX). There is a tendency that the higher the zirconium concentration in the electrolysis solution is, the more zirconium is incorporated assuming that the metal substrate is the same. However, the ease of incorporation differs depending on the type of metal substrate and alloy type. The zirconium content particularly affects the hardness of the resulting ceramic film and as a result the sliding properties closely related with the hardness are easily affected by the zirconium content. At a zirconium content of less than 5%, good adhesion and flexibility of the ceramic film owing to the inclusion of zirconium is not easily obtained.

The distribution of the zirconium concentration in the cross-sectional direction of the ceramic film in the invention may not be uniform and the zirconium concentration may gradually decrease from the surface side of the ceramic film toward the metal substrate side. Also in this case, the average zirconium content with respect to the whole film is preferably within the foregoing range. The concentration distribution is gradually decreased to enable a sharp composition gradient to be avoided to further improve the film adhesion and toughness. The film contains as its main ingredients the oxide of the ingredient of the metal-substrate and zirconium oxide, but ingredients which are present in the electrolysis solution may be incorporated in the film in small amounts.

Zirconium oxide in the ceramic film preferably includes tetragonal zirconium oxide and/or cubic zirconium oxide. It is known that zirconium oxide causes crystal modification upon the application of a stress and shows a high toughness after the stress relaxation although it is a ceramic material. The cubic zirconium oxide is readily produced by incorporating calcium oxide, cerium oxide, or yttrium oxide, and the stabilized zirconia and/or partly stabilized zirconia which was produced exhibits high toughness. The ceramic film of the invention contains zirconium oxide as its main ingredient and therefore has good adhesion and good flexibility. The ceramic film does not easily come off but follows the substrate in the treated section if a treatment is slightly performed. The impact resistance is also good owing to the good adhesion and flexibility.

The thickness of the film obtained by the method of electrolytic ceramic coating on metal according to the invention is not particularly limited and a desired thickness may be selected according to the intended use. In general, however, the film thickness is preferably from 0.1 to 100 μm, more preferably from 1 to 60 μm and even more preferably from 2 to 20 μm. At a film thickness within the foregoing range, the impact resistance is excellent and the electrolysis time is not so long that the economical efficiency is not poor. In general, the thicker the film is, the more the film is roughened. Therefore, in applications which require the smoothness, the treatment is preferably performed to obtain a thickness of 2 to 10 μm and more preferably 3 to 7 μm. Particularly in applications which require the smoothness, the constant voltage process is preferably used on the positive side and the bipolar treatment also using the constant voltage process on the negative side is more preferably performed.

The film obtained by the method of electrolytic ceramic coating on metal according to the invention preferably has a surface roughness in terms of centerline mean roughness (arithmetic mean roughness; Ra according to JIS) of 0.01 to 10 μm and more preferably from 0.05 to 3 μm. Particularly in applications which require surface smoothness, the centerline mean roughness is preferably from 0.1 to 1 μm. At a centerline mean roughness within the foregoing range, the film has a low likelihood of attacking the counterpart member and a low coefficient of friction.

The anodization which generally involves spark discharge is characterized in that recesses like volcano craters are formed at the film surface, and the recesses properly act as oil reservoirs under oil lubrication and contributes to a low coefficient of friction. The surface roughness of the film may be measured by appropriately using a contact surface roughness tester or a non-contact laser microscope or microscope.

The Vickers hardness of the ceramic film varies with the ingredients of the metal substrate and the electrolysis solution and is usually from 450 to 1,900 Hv. The hardness of the ceramic film may be appropriately adjusted according to the intended use. When used in sliding applications, the film attacks the counterpart member if it is too hard and is worn out if it is too soft. Therefore, it is usually preferred for the ceramic film to have substantially the same hardness as that of the counterpart member. However, when the PEO film containing zirconium is compared with that containing no zirconium, the former has a lower likelihood of attacking the counterpart member upon sliding and also has a lower coefficient of friction even if the surface roughness and the hardness are substantially the same. It is not known exactly why but the inventors presume that the differences between the two films are due to the flexibility and toughness the zirconium has.

As described above, the main ingredients of the film include the oxide of the substrate material and zirconium oxide. Aluminum oxide when the substrate material is aluminum or an aluminum alloy, magnesium oxide when it is magnesium or a magnesium alloy, or titanium oxide when it is titanium or a titanium alloy is the oxide formed from the ingredient of the substrate. The film may also contain other film ingredients such as alloying ingredients added and water-soluble metal ingredients and poorly soluble metal compound particles added to the electrolysis solution. The hardness of the film obtained by the invention is the net hardness of the film under the combined action of the oxides.

The film hardness is adjusted by controlling the composition of the resulting film depending on the amount of zirconium in the electrolysis solution, and the type and amount of water-soluble metal ingredients and poorly soluble metal compound particles added to the electrolysis solution. In an example in which a composite ceramic film of the oxide of aluminum supplied from the substrate and the oxide of zirconium supplied from the electrolysis solution is formed on the aluminum alloy according to the invention, the higher the aluminum oxide content ratio is, the higher the film hardness is, and the higher the zirconium oxide content ratio is, the lower the film hardness is.

[Multistep Treatment]

According to the method of the invention, different electrolysis solutions may be used to perform the treatment in several steps to form the ceramic film on the metallic material. The multilayered film structure can be thus optionally obtained. For example, a treatment of a metallic material in an electrolysis solution for forming a ceramic film with high film hardness is followed by a treatment of the metallic material in another electrolysis solution for forming a ceramic film with low film hardness, resulting in a film with a soft surface and a hard interior.

As described above, anionic ingredients such as a complexing agent, carbonate ion and a water-soluble phosphate compound effectively act as film-forming aids in the method of the invention. When the content of the film-forming aid in the electrolysis solution is not sufficient, the formation of the film is not readily started even if a sufficient amount of current is flowed. However, inclusion of a sufficient amount of film-forming aid in the electrolysis solution enables the formation of a ceramic film having an electric resistance on the surface of a substrate metal having a small electric resistance to be started. Therefore, it is also possible to use an electrolysis solution containing a sufficient amount of film-forming aid to form a first layer of the ceramic film on the metallic material and then to use a solution containing an insufficient amount of film-forming aid for the subsequent film growth. This has the merit that the costs involved in forming the ceramic film is substantially reduced and also the merit that other ingredients which could not be added due to limitations on electrical conductivity can be added in larger amounts by excluding the film-forming aid from the electrolysis solution.

[Post-Treatment]

In the method of the invention, the formation of the ceramic film may be followed by post-treatments such as polishing, boiling, sealing, lubrication and coating depending on the intended use.

In applications which further require the smoothness, it is preferred to smooth the ceramic surface as the subsequent step by mechanical polishing such as lapping or polishing. Usually, the thicker the film is, the more the surface roughness is increased. Therefore, in the case of a film with a thickness above 50 μm, it may be difficult to reduce the surface roughness Ra below 1 μm even after the anodization is performed according to the invention. In such a case, the smoothness can be imparted to a thick film by performing the mechanical polishing in the subsequent step.

Compared to cases where typical treatments such as anodization, plating and chemical conversion treatment are performed, the molded article after the PEO treatment has better corrosion resistance without further treatment. However, perforating defects slightly reaching the metal substrate may exist. In order to plug up the defects, it is preferred to perform a boiling treatment in boiling water, various chemical conversion treatments or a filling treatment with a film-forming resin or an inorganic substance. In such a case, the uppermost surface portion is the oxide film itself and therefore the properties such as the hardness of the oxide film do not change.

The boiling treatment may be performed by, for example, immersing the film in a hot water at 90 to 100° C. for about 5 to about 60 minutes. The boiling treatment enables the oxide or hydroxide of the substrate material to grow at the defective portions and therefore has the pore-filling effect.

For example in cases where a phosphate treatment is performed as a typical chemical conversion treatment, the liquid reaches the metal substrate only at the defective portions, where a phosphate is formed. The chemical conversion treatment thus exhibits the pore-filling effect. Exemplary phosphate treatments that may be used include zinc phosphate treatment, manganese phosphate treatment, calcium phosphate treatment, iron phosphate treatment and chromium phosphate treatment.

The post-treatment using a film-forming inorganic substance or resin is performed by a method which involves dipping the metallic material having the ceramic film formed thereon in the invention in an aqueous solution containing at least one of zirconium ammonium carbonate, colloidal silica, water glass, silane coupling agent and water-dispersible resin, or applying the aqueous solution with a spray or brush, let the solution dry naturally and optionally baking. In this case, the aqueous solution which permeated the defective pores by capillary action is solidified after drying and has the pore-filling effect. Vacuum impregnation performed as a pore permeation means further has a sufficient pore-filling effect.

In order to further improve the sliding properties, a thermosetting resin containing at least one of polyimide, polyamide-imide and polybenzimidazole is preferably applied to the molded article obtained by forming the ceramic film in the invention to a thickness of 0.1 to 5 μm and more preferably 0.5 to 2 μm. This has the action of reducing the surface roughness of the oxide film, and the layer formed is softer than the oxide film and enables the coefficient of friction to be reduced while improving the initial break-in condition.

At least one solid lubricant selected from the group consisting of graphite, polytetrafluoroethylene, molybdenum disulfide and boron nitride may be applied to the molded article having the ceramic film formed therein. It is also effective to disperse any of the solid lubricants in the thermosetting resin and apply the dispersion thereto.

The metallic member in which the ceramic film is formed and optionally received any of the post-treatments according to the method of the invention can be used without further treatment but a resin coating may also be applied to form an upper layer in order to improve the design and corrosion resistance. Fine irregularities present at the ceramic film exhibits an anchor effect and the adhesion after the coating is extremely good. The ceramic film obtained by the method of the invention is an oxide film having a low porosity and therefore does not readily cause blistering when the resin coating is baked.

Even in the case of coating to form a thinner film, the purpose is fully achieved by combination with good corrosion resistance and smoothness of the ceramic film itself. In other words, the resin coating formed on the ceramic film has good smoothness and therefore the colored product may have a beautiful appearance. The coating dramatically improves the corrosion resistance of the substrate metal. The oxide film containing zirconium is hard and tenacious and therefore is resistant to scratches reaching the metal substrate even upon impact from above. And, the oxide film containing zirconium is also chemically stable. Therefore, in cases where a scratch reaching the substrate is formed, the dissolution of the base coat film due to an acid or alkali in the corroded portions does not proceed to more dramatically improve the corrosion resistance than conventional base for coating.

The coating used is not particularly limited and a solvent coating, an aqueous coating and a powder coating which are commonly used for coating may be employed. The coatings may be of a thermosetting type which requires high temperature baking after the application or of a type which is cross-linked and cured without a baking step after the volatilization of a solvent at around room temperature. The coating method is also not particularly limited and known methods including spray coating, dip coating, electrodeposition coating and powder coating may be used.

The metallic member of the invention is one which includes a substrate made of a metal selected from the group consisting of aluminum, an aluminum alloy, magnesium, a magnesium alloy, titanium and a titanium alloy, and a ceramic film present on the metal substrate, and in which the ceramic film is formed by the method of electrolytic ceramic coating of the invention, has a thickness of 0.1 to 100 μm and contains zirconium in an amount of 5 to 70 wt %.

The intended purpose of the metallic member of the invention is not particularly limited. For example, the inventive metallic member including the substrate of a low-hardness metal such as aluminum, magnesium or titanium can be advantageously used in sliding members in which these low-hardness metals have conventionally been unusable. The ceramic film made of zirconium is excellent in the heat resistance, resistance to repeated impacts and corrosion resistance, and therefore the metallic member of the invention may be advantageously used for the purpose of protecting various members. The ceramic film has a smaller specific surface area and more excellent degassing properties than conventional anodized films and therefore it can be expected that the time required to pump out the vacuum chamber is shortened while favorably keeping the cleanliness and the degree of vacuum.

Specific examples of the part to which the invention may be applied are illustrated below.

Exemplary parts that may be advantageously used include sliding parts and wear parts on the periphery of the engine and of the drive system in portable generators, grass cutters, outboard motors, automobiles, motorcycles, tractors and bulldozers, as exemplified by engine liner inner walls, engine cylinder inner walls, engine piston grooves, engine piston skirts, engine piston pin boss holes, engine shafts, engine valves, engine retainers, engine lifters, engine cams, engine pulleys, engine sprockets, engine connecting rods, turbo housings, turbo fins, inner walls of various compressors, swash plates, inner walls of various pumps, shock absorber inner walls, and brake master cylinders. Many of these parts require both of the heat resistance and heat dissipation properties but the ceramic film is more advantageous because it has both of the heat resistance and heat dissipation properties.

The invention may be advantageously used in parts of automobiles, motorcycles and outboard motors mainly requiring the corrosion resistance, as exemplified by engine head covers, engine block cases, oil pans, shock absorber case outer walls, wheel parts, wheel nuts, brake calipers, rocker arm parts, outboard motor engine covers, and gearboxes. In these applications which require the corrosion resistance, the formation of the ceramic film is more preferably followed by resin coating. Of these, particularly automobile chassis parts which have the ceramic film of the invention are preferably subjected to resin coating because good corrosion resistance and good pitting resistance are obtained. This treatment enables even magnesium wheels which do not have sufficient performance after other surface preparation step to have high durability in practical use.

Examples of various mechanical parts to which the invention may be advantageously applied include those requiring the corrosion resistance such as compressor cylinder inner walls, mobile phone frames, eyeglass frames, business cases, speaker diaphragms and angling parts; those requiring the sliding properties and wear resistance such as injection nozzle parts, fasteners, sashes, compressor cylinder inner walls, molds for resin molding, fluid propellers, gear parts and paper pickup parts in printing presses; those particularly requiring the heat resistance such as furnace inner walls, gas turbines and molds for resin molding; those requiring the degassing properties such as vacuum chamber inner walls and chamber inner walls in semiconductor manufacturing devices; those primarily requiring the heat dissipation properties such as heat sinks and heat exchanger parts; and those primarily requiring the insulation properties such as printed boards, battery inner walls, notebook computer casings, mobile phone casings and mobile electronic device casings.

The invention is very often applied to sporting goods and may be advantageously used in parts requiring the impact resistance such as golf club heads, those requiring the corrosion resistance such as fishing reel cases and handle stay parts; those requiring the wear resistance such as bicycle gear parts and pedals; and those requiring the corrosion resistance such as bicycle handles and frames.

EXAMPLES

The present invention is described below more specifically by way of examples and comparative examples. However, the present invention is not limited thereto.

One side of plates with a thickness of 1 mm and a size of 10 cm square was masked to adjust the surface area to 1 $dm^2$ and the plates were used for the metal substrate on which a ceramic film is to be formed. The plates were fully polished with emery paper (grit size: 2,000) before treatment and then fully cleaned by ultrasonic cleaning with acetone.

1. Formation of Ceramic Film (Aluminum Member)

Example 1

An electrolysis solution was prepared by adding to water water-soluble zirconium ammonium carbonate at a concentration in terms of zirconium of 0.009 mol/L (=X), citrate ions in an amount of 0.0015 mol/L (=Y) and potassium carbonate in a carbonate ion amount of 0.028 mol/L (=Z) in combination with the carbonate from the zirconium ammonium carbonate. The electrolysis solution was adjusted with sodium hydroxide, sodium citrate and citric acid to a pH of 11.0. The thus obtained electrolysis solution had an electrical conductivity at 20° C. of 1.7 S/m and the ratios Y/X and Z/X were 0.17 and 3.1, respectively.

This electrolysis solution was adjusted to 20° C. and used. A plate of wrought aluminum (JIS 1050 material) with a surface area of 1 $dm^2$ and a stainless steel plate were used as a working electrode and a counter electrode, respectively to perform a bipolar electrolytic treatment for 20 minutes, thereby forming a ceramic film on a surface of the aluminum plate. The surface of the anode during the electrolysis was observed and light emission from the arc discharge and/or glow discharge was found to take place.

The conditions on the bipolar treatment were as follows: The voltage was controlled on both of the positive and negative sides so as to have a sinusoidal waveform; the positive and negative peak voltage values were set to 550 V and 150 V, respectively; the duty ratio on the positive side (T1) and that on the negative side (T2) were set to 0.15 and 0.05, respectively; and the frequency was set to 10,000 Hz. The pulse off period (T3) was 0.80 and the ratios T2/T1 and T3/(T1+T2) were set to 0.3 and 4.0, respectively. During the treatment, the peak current density on the positive side fluctuated in a range of 0.5 to 40 $A/dm^2$. During the treatment, there was particularly no change in the appearance of the solution or formation of precipitates, and the electrolysis solution was stable.

Example 2

An electrolysis solution was prepared by adding to water water-soluble zirconium potassium carbonate at a concentration in terms of zirconium of 0.40 mol/L (=X), oxalate ions in an amount of 0.0080 mol/L (=Y), lithium carbonate in a carbonate ion amount of 1.10 mol/L (=Z) in combination with the carbonate from the zirconium potassium carbonate and pyrophosphate ions at a concentration in terms of phosphorus of 0.008 mol/L. The electrolysis solution was adjusted with ammonia, oxalic acid, sodium oxalate, pyrophosphoric acid and sodium pyrophosphate to a pH of 10.0. The thus obtained electrolysis solution had an electrical conductivity at 40° C. of 7.1 S/m and the ratios Y/X and Z/X were 0.02 and 2.8, respectively.

This electrolysis solution was adjusted to 40° C. and used. A plate of wrought aluminum (JIS 4043 material) with a surface area of 1 $dm^2$ and a stainless steel plate were used as a working electrode and a counter electrode, respectively to perform a bipolar electrolytic treatment for 10 minutes, thereby forming a ceramic film on a surface of the aluminum plate. The surface of the anode during the electrolysis was observed and light emission from the arc discharge and/or glow discharge was found to take place.

The conditions on the bipolar treatment were as follows: The current was controlled on the positive side, whereas the voltage was controlled on the negative side so as to have a square waveform on both the sides; the positive peak current value was set to 2 $A/dm^2$; the negative peak voltage value was set to 150 V; the duty ratio on the positive side (Ti) and that on the negative side (T2) were set to 0.10 and 0.20, respectively; and the frequency was set to 5,000 Hz. The pulse off period (T3) was 0.70 and the ratios T2/T1 and T3/(T1+T2) were set to 2.0 and 2.3, respectively. During the treatment, the peak voltage on the positive side fluctuated in a range of 150 to 650 V. During the treatment, there was particularly no change in the appearance of the solution or formation of precipitates, and the electrolysis solution was stable.

Example 3

An electrolysis solution was prepared by adding to water water-soluble zirconium potassium carbonate at a concentration in terms of zirconium of 0.0063 mol/L (=X), tartrate ions in an amount of 0.15 mol/L (=Y), potassium carbonate in a carbonate ion amount of 0.113 mol/L (=Z) in combination with the carbonate from the zirconium potassium carbonate and pyrophosphate ions at a concentration in terms of phosphorus of 0.1 mol/L. The electrolysis solution was adjusted with potassium hydroxide, sodium potassium tartrate, tartaric acid, pyrophosphoric acid and potassium pyrophosphate to a pH of 9.0. The thus obtained electrolysis solution had an electrical conductivity at 4° C. of 1.8 S/m and the ratios Y/X and Z/X were 23.8 and 17.9, respectively.

This electrolysis solution was adjusted to 4° C. and used. A plate of die casting aluminum alloy (JIS ADC6 material) with a surface area of 1 $dm^2$ and a stainless steel plate were used as a working electrode and a counter electrode, respectively to perform a two-step bipolar electrolytic treatment for a total period of 50 minutes, thereby forming a ceramic film on a surface of the aluminum plate. The surface of the anode during the treatment was observed in the two-step electrolytic treatment and light emission from the arc discharge and/or glow discharge was found to take place.

The first step of the two-step bipolar treatment was performed for 20 minutes under the following conditions: The voltage was controlled on both of the positive and negative sides so as to have a square waveform; the positive and negative peak voltage values were set to 550 V and 100 V, respectively; the duty ratio on the positive side (T1) and that on the negative side (T2) were set to 0.10 and 0.10, respectively; and the frequency was set to 60 Hz. The pulse off period (T3) was 0.80 and the ratios T2/T1 and T3/(T1+T2) were set to 1.0 and 4.0, respectively. During the first step, the peak current density on the positive side fluctuated in a range of 0.5 to 40 A/dm$^2$.

The second step of the two-step bipolar treatment was performed for 30 minutes under the following conditions: The current was controlled on the positive side, whereas the voltage was controlled on the negative side so as to have a square waveform on both the sides; the positive peak current value was set to 1.9 A/dm$^2$; the negative peak voltage value was set to 100 V; the duty ratio on the positive side (Ti) and that on the negative side (T2) were set to 0.10 and 0.10, respectively; and the frequency was set to 60 Hz. The pulse off period (T3) was 0.80 and the ratios T2/T1 and T3/(T1+T2) were set to 1.0 and 4.0, respectively. During the second step, the peak voltage on the positive side fluctuated in a range of 150 to 650 V. During the treatment, there was particularly no change in the appearance of the solution or formation of precipitates, and the electrolysis solution was stable.

Example 4

The same electrolysis solution as used in Example 3 was adjusted to 4° C. and used. A plate of wrought aluminum (JIS 2011 material) and a stainless steel plate were used as a working electrode and a counter electrode, respectively to perform a two-step bipolar electrolytic treatment for a total period of 70 minutes, thereby forming a ceramic film on a surface of the aluminum plate. The surface of the anode during the treatment was observed in the two-step electrolytic treatment and light emission from the arc discharge and/or glow discharge was found to take place.

The second step of the two-step bipolar treatment was performed for 30 minutes under the following conditions: The current was controlled on the positive side, whereas the voltage was controlled on the negative side so as to have a square waveform on both the sides; the positive peak current value was set to 3.0 A/dm$^2$; the negative peak voltage value was set to 100 V; the duty ratio on the positive side (T1) and that on the negative side (T2) were set to 0.15 and 0.10, respectively; and the frequency was set to 60 Hz. The pulse off period (T3) was 0.75 and the ratios T2/T1 and T3/(T1+T2) were set to 0.7 and 3.0, respectively. During the first step, the peak voltage on the positive side fluctuated in a range of 150 to 650 V.

The second step of the two-step bipolar treatment was performed for 40 minutes under the following conditions: The current was controlled on the positive side, whereas the voltage was controlled on the negative side so as to have a square waveform on both the sides; the positive peak current value was set to 1.9 A/dm$^2$; the negative peak voltage value was set to 100 V; the duty ratio on the positive side (T1) and that on the negative side (T2) were set to 0.10 and 0.10, respectively; and the frequency was set to 60 Hz. The pulse off period (T3) was 0.80 and the ratios T2/T1 and T3/(T1+T2) were set to 1.0 and 4.0, respectively. During the second step, the peak voltage on the positive side fluctuated in a range of 150 to 650 V. During the treatment, there was particularly no change in the appearance of the solution or formation of precipitates, and the electrolysis solution was stable.

Example 5

An electrolysis solution was prepared by adding to water water-soluble zirconium ammonium carbonate at a concentration in terms of zirconium of 0.020 mol/L (=X), tartrate ions in an amount of 0.05 mol/L (=Y), ammonium carbonate in a carbonate ion amount of 0.060 mol/L (=Z) in combination with the carbonate from the zirconium ammonium carbonate, and pyrophosphate ions at a concentration in terms of phosphorus of 0.15 mol/L. The electrolysis solution was adjusted with potassium hydroxide, potassium tartrate, tartaric acid, pyrophosphoric acid and sodium pyrophosphate to a pH of 7.6. The thus obtained electrolysis solution had an electrical conductivity at 20° C. of 1.4 S/m and the ratios Y/X and Z/X were 2.5 and 3.0, respectively.

This electrolysis solution was adjusted to 20° C. and used. A plate of die casting aluminum alloy (JIS ADC5 material) with a surface area of 1 dm$^2$ and a stainless steel plate were used as a working electrode and a counter electrode, respectively to perform a two-step electrolytic treatment including the first monopolar electrolysis process and its subsequent bipolar electrolysis process for a total period of 20 minutes, thereby forming a ceramic film on a surface of the aluminum plate. The surface of the anode during the treatment was observed in the two-step electrolytic treatment and light emission from the arc discharge and/or glow discharge was found to take place.

The first monopolar electrolysis process was performed for 10 minutes under the following conditions: No application was made to the negative side; the voltage was controlled only on the positive side so as to have a sinusoidal waveform; the positive peak voltage value was set to 380 V; the duty ratio (T1) was set to 0.12 and the frequency was set to 60 Hz. The pulse off period (T3) was 0.88. During the first step, the peak current density on the positive side fluctuated in a range of 0.5 to 40 A/dm$^2$.

The second step was performed for 10 minutes under the following conditions: The voltage was controlled on both of the positive and negative sides so as to have a sinusoidal waveform; the positive and negative peak voltage values were set to 550 V and 120 V, respectively; the duty ratio on the positive side (T1) and that on the negative side (T2) were set to 0.12 and 0.12, respectively; and the frequency was set to 100 Hz. The pulse off period (T3) was 0.80 and the ratios T2/T1 and T3/(T1+T2) were set to 1.0 and 3.2, respectively. During the second step, the peak current density on the positive side fluctuated in a range of 0.5 to 40 A/dm$^2$. During the treatment, there was particularly no change in the appearance of the solution or formation of precipitates, and the electrolysis solution was stable.

Example 6

An electrolysis solution was prepared by adding to water water-soluble zirconium potassium carbonate at a concentration in terms of zirconium of 0.010 mol/L (=X), citrate ions in an amount of 0.0010 mol/L (=Y), sodium carbonate in a carbonate ion amount of 0.12 mol/L (=Z) in combination with the carbonate from the zirconium potassium carbonate, and orthophosphate ions at a concentration in terms of phosphorus of 0.40 mol/L. The electrolysis solution was adjusted with potassium hydroxide, potassium citrate, citric acid, orthophosphoric acid and sodium orthophosphate to a pH of 10. The thus obtained electrolysis solution had an electrical conductivity at 20° C. of 3.2 S/m and the ratios Y/X and Z/X were 0.10 and 12.0, respectively.

This electrolysis solution was adjusted to 20° C. and used. A plate of die casting aluminum alloy (JIS ADC10 material) with a surface area of 1 dm$^2$ and a stainless steel plate were used as a working electrode and a counter electrode, respectively to perform a bipolar electrolytic treatment for 20 minutes, thereby forming a ceramic film on a surface of the aluminum plate. The surface of the anode during the electrolysis was observed and light emission from the arc discharge and/or glow discharge was found to take place.

The conditions on the bipolar treatment were as follows: The current was controlled on the positive side, whereas the voltage was controlled on the negative side so as to have a sinusoidal waveform on the positive side and a triangular waveform on the negative side; the positive peak current value was set to 3 A/dm$^2$; the negative peak voltage value was set to 100 V; the duty ratio on the positive side (T1) and that on the negative side (T2) were set to 0.10 and 0.01, respectively; and the frequency was set to 100 Hz. The pulse off period (T3) was 0.89 and the ratios T2/T1 and T3/(T1+T2) were set to 0.1 and 8.1, respectively. During the treatment, the peak voltage on the positive side fluctuated in a range of 150 to 650 V. During the treatment, there was particularly no change in the appearance of the solution or formation of precipitates, and the electrolysis solution was stable.

Example 7

The same electrolysis solution as used in Example 3 was adjusted to 4° C. and used. A plate of wrought aluminum (JIS 5052 material) with a surface area of 1 dm$^2$ and a stainless steel plate were used as a working electrode and a counter electrode, respectively to perform a two-step bipolar electrolytic treatment for a total period of 20 minutes, thereby forming a ceramic film on a surface of the aluminum plate. The surface of the anode during the treatment was observed in the two-step electrolytic treatment and light emission from the arc discharge and/or glow discharge was found to take place.

The first step of the two-step bipolar treatment was performed for 2 minutes under the following conditions: The current was controlled on both of the positive and negative sides so as to have a sinusoidal waveform; the positive and negative peak current values were set to 3.1 A/dm$^2$ and 5.0 A/dm$^2$, respectively; the duty ratio on the positive side (T1) and that on the negative side (T2) were set to 0.10 and 0.10, respectively; and the frequency was set to 14,000 Hz. The pulse off period (T3) was 0.80 and the ratios T2/T1 and T3/(T1+T2) were set to 1.0 and 4.0, respectively. During the first step, the peak voltage on the positive side fluctuated in a range of 150 to 650 V and that on the negative side fluctuated in a range of 10 to 350 V.

The second step of the two-step bipolar treatment was performed for 18 minutes under the following conditions: The current was controlled on both of the positive and negative sides so as to have a square waveform; the positive and negative peak current values were set to 0.9 A/dm$^2$ and 2.5 A/dm$^2$, respectively; the duty ratio on the positive side (T1) and that on the negative side (T2) were set to 0.10 and 0.10, respectively; and the frequency was set to 60 Hz. The pulse off period (T3) was 0.80 and the ratios T2/T1 and T3/(T1+T2) were set to 1.0 and 4.0, respectively. During the second step, the peak voltage on the positive side fluctuated in a range of 150 to 650 V and that on the negative side fluctuated in a range of 10 to 350 V. During the treatment, there was particularly no change in the appearance of the solution or formation of precipitates, and the electrolysis solution was stable.

Example 8

An electrolysis solution was prepared by adding to water water-soluble zirconium potassium carbonate at a concentration in terms of zirconium of 0.015 mol/L (=X), malate ions in an amount of 0.0030 mol/L (=Y), potassium carbonate in a carbonate ion amount of 0.13 mol/L (=Z) in combination with the carbonate from the zirconium potassium carbonate, and orthophosphate ions at a concentration in terms of phosphorus of 0.07 mol/L. To this solution was added an alumina particle dispersion containing 2 g/L alumina particles with an average particle size of 20 to 50 nm to obtain a suspended electrolysis solution. The electrolysis solution was adjusted with potassium hydroxide, sodium malate, malic acid, orthophosphoric acid and sodium orthophosphate to a pH of 8.0. The thus obtained electrolysis solution had an electrical conductivity at 20° C. of 1.5 S/m and the ratios Y/X and Z/X were 0.20 and 8.7, respectively.

This electrolysis solution was adjusted to 20° C. and used. A plate of die casting aluminum alloy (JIS ADC12 material) with a surface area of 1 dm$^2$ and a titanium plate were used as a working electrode and a counter electrode, respectively to perform a bipolar electrolytic treatment for 10 minutes, thereby forming a ceramic film on a surface of the aluminum plate. The surface of the anode during the electrolysis was observed and light emission from the arc discharge and/or glow discharge was found to take place.

The conditions on the bipolar treatment were as follows: The voltage was controlled on both of the positive and negative sides so as to have a square waveform; the positive and negative peak voltage values were set to 550 V and 90 V, respectively; the duty ratio on the positive side (T1) and that on the negative side (T2) were set to 0.08 and 0.10, respectively; and the frequency was set to 180 Hz. The pulse off period (T3) was 0.82 and the ratios T2/T1 and T3/(T1+T2) were set to 1.3 and 4.6, respectively. During the treatment, the peak current density on the positive side fluctuated in a range of 0.5 to 40 A/dm$^2$. During the treatment, there was particularly no change in the appearance of the solution or formation of precipitates, and the electrolysis solution was stable.

Example 9

An electrolysis solution was prepared by adding to water water-soluble zirconium potassium carbonate at a concentration in terms of zirconium of 0.015 mol/L (=X), gluconate ions in an amount of 0.0030 mol/L (=Y), potassium carbonate in a carbonate ion amount of 0.13 mol/L (=Z) in combination with the carbonate from the zirconium potassium carbonate, and orthophosphate ions at a concentration in terms of phosphorus of 0.07 mol/L. To this solution was added a chromium carbide particle dispersion containing 5 g/L chromium carbide particles with an average particle size of 300 to 500 nm to obtain a suspended electrolysis solution. The electrolysis solution was adjusted with potassium hydroxide, sodium gluconate, gluconic acid, orthophosphoric acid and sodium orthophosphate to a pH of 8.0. The thus obtained electrolysis solution had an electrical conductivity at 20° C. of 1.5 S/m and the ratios Y/X and Z/X were 0.20 and 8.7, respectively.

This electrolysis solution was adjusted to 20° C. and used. A plate of die casting aluminum alloy (JIS ADC12 material) with a surface area of 1 dm$^2$ and a titanium plate were used as a working electrode and a counter electrode, respectively to perform a bipolar electrolytic treatment for 10 minutes, thereby forming a ceramic film on a surface of the aluminum plate. The surface of the anode during the electrolysis was observed and light emission from the arc discharge and/or glow discharge was found to take place.

The conditions on the bipolar treatment were as follows: The voltage was controlled on both of the positive and negative sides so as to have a square waveform; the positive and negative peak voltage values were set to 550 V and 90 V, respectively; the duty ratio on the positive side (T1) and that on the negative side (T2) were set to 0.08 and 0.10, respectively; and the frequency was set to 180 Hz. The pulse off period (T3) was 0.82 and the ratios T2/T1 and T3/(T1+T2) were set to 1.3 and 4.6, respectively. During the treatment, the peak current density on the positive side fluctuated in a range of 0.5 to 40 A/dm$^2$. During the treatment, there was particularly no change in the appearance of the solution or formation of precipitates, and the electrolysis solution was stable.

Example 10

An electrolysis solution was prepared by adding to water water-soluble zirconium potassium carbonate at a concentration in terms of zirconium of 0.010 mol/L (=X), ascorbate ions in an amount of 0.0050 mol/L (=Y), sodium carbonate in a carbonate ion amount of 0.05 mol/L (=Z) in combination with the carbonate from the zirconium potassium carbonate, pyrophosphate ions at a concentration in terms of phosphorus of 0.05 mol/L, and titanium lactate at a concentration in terms of titanium of 0.01 mol/L. The electrolysis solution was adjusted with monoethanolamine, sodium ascorbate, ascorbic acid, pyrophosphoric acid and sodium pyrophosphate to a pH of 10.0. The thus obtained electrolysis solution had an electrical conductivity at 8° C. of 1.6 S/m and the ratios Y/X and Z/X were 0.50 and 5.0, respectively.

This electrolysis solution was adjusted to 8° C. and used. A plate of wrought aluminum (JIS 7075 material) with a surface area of 1 dm$^2$ and a stainless steel plate were used as a working electrode and a counter electrode, respectively to perform a bipolar electrolytic treatment for 10 minutes, thereby forming a ceramic film on a surface of the aluminum plate. The surface of the anode during the electrolysis was observed and light emission from the arc discharge and/or glow discharge was found to take place.

The conditions on the bipolar treatment were as follows: The voltage was controlled on both of the positive and negative sides so as to have a sinusoidal waveform; the positive and negative peak voltage values were set to 400 V and 180 V, respectively; the duty ratio on the positive side (T1) and that on the negative side (T2) were set to 0.10 and 0.05, respectively; and the frequency was set to 60 Hz. The pulse off period (T3) was 0.85 and the ratios T2/T1 and T3/(T1+T2) were set to 0.5 and 5.7, respectively. During the treatment, the peak current density on the positive side fluctuated in a range of 0.5 to 40 A/dm$^2$. During the treatment, there was particularly no change in the appearance of the solution or formation of precipitates, and the electrolysis solution was stable.

Example 11

An electrolysis solution was prepared by adding to water water-soluble zirconium potassium carbonate at a concentration in terms of zirconium of 0.020 mol/L (=X), tartrate ions in an amount of 0.0050 mol/L (=Y), potassium carbonate in a carbonate ion amount of 0.14 mol/L (=Z) in combination with the carbonate from the zirconium potassium carbonate, and orthophosphate ions at a concentration in terms of phosphorus of 0.06 mol/L. The electrolysis solution was adjusted with sodium hydroxide, sodium potassium tartrate, tartaric acid, orthophosphoric acid and potassium orthophosphate to a pH of 11.0. The thus obtained electrolysis solution had an electrical conductivity at 5° C. of 1.3 S/m and the ratios Y/X and Z/X were 0.25 and 7.0, respectively.

This electrolysis solution was adjusted to 5° C. and used. A plate of die casting aluminum alloy (JIS ADC12 material) with a surface area of 1 dm$^2$ and a stainless steel plate were used as a working electrode and a counter electrode, respectively to perform a bipolar electrolytic treatment for 20 minutes, thereby forming a ceramic film on a surface of the aluminum plate. The surface of the anode during the electrolysis was observed and light emission from the arc discharge and/or glow discharge was found to take place.

The conditions on the bipolar treatment were as follows: The voltage was controlled on both of the positive and negative sides so as to have a sinusoidal waveform; the positive and negative peak voltage values were set to 550 V and 80 V, respectively; the duty ratio on the positive side (T1) and that on the negative side (T2) were set to 0.15 and 0.10, respectively; and the frequency was set to 60 Hz. The pulse off period (T3) was 0.75 and the ratios T2/T1 and T3/(T1+T2) were set to 0.7 and 3.0, respectively. During the treatment, the peak current density on the positive side fluctuated in a range of 0.5 to 40 A/dm$^2$. During the treatment, there was particularly no change in the appearance of the solution or formation of precipitates, and the electrolysis solution was stable.

[Bipolar Treatment on Only Positive Side (Aluminum Member)]

Example 12

The same electrolysis solution and substrate as used in Example 11 were used and, of the electrolysis conditions, the control on the negative side was only different. More specifically, the same electrolysis solution as used in Example 11 was adjusted to 5° C. and used. A plate of die casting aluminum alloy (JIS ADC12 material) with a surface area of 1 dm$^2$ and a stainless steel were used as a working electrode and a counter electrode, respectively to perform a bipolar electrolytic treatment for 20 minutes, thereby forming a ceramic film on a surface of the aluminum plate. The surface of the anode during the electrolysis was observed and light emission from the arc discharge and/or glow discharge was found to take place.

The conditions on the bipolar treatment were as follows: The voltage was only applied to the positive side and controlled so as to have a sinusoidal waveform; the positive peak voltage value was set to 550 V; the duty ratio on the positive side (T1) was set to 0.15; and the frequency was set to 60 Hz. The pulse off period (T3) was 0.85 and the ratios T2/T1 and T3/(T1+T2) were set to 0 and 5.7, respectively. During the treatment, the peak current density on the positive side fluctuated in a range of 0.5 to 40 A/dm$^2$. During the treatment, there was particularly no change in the appearance of the solution or formation of precipitates, and the electrolysis solution was stable.

Example 13

An electrolysis solution was prepared by adding to water water-soluble zirconium potassium carbonate at a concentration in terms of zirconium of 0.020 mol/L (=X), tartrate ions in an amount of 0.005 mol/L (=Y) and ammonium carbonate in a carbonate ion amount of 0.14 mol/L (=Z) in combination with the carbonate from the zirconium potassium carbonate. The electrolysis solution was adjusted with sodium hydroxide, sodium potassium tartrate and tartaric acid to a pH of 11.0. The thus obtained electrolysis solution had an electrical conductivity at 5° C. of 1.3 S/m and the ratios Y/X and Z/X were 0.25 and 7.0, respectively.

This electrolysis solution was adjusted to 5° C. and used. A plate of wrought aluminum (JIS 1050 material) with a surface area of 1 dm$^2$ and a stainless steel plate were used as a working electrode and a counter electrode, respectively to perform a monopolar electrolytic treatment for 10 minutes, thereby forming a ceramic film on a surface of the aluminum plate. The surface of the anode during the electrolysis was observed and light emission from the arc discharge and/or glow discharge was found to take place.

The monopolar treatment was performed for 10 minutes under the following conditions: No application was made to the negative side; the voltage was controlled only on the positive side so as to have a sinusoidal waveform; the positive peak voltage value was set to 550 V; the duty ratio (T1) was set to 0.15 and the frequency was set to 60 Hz. The pulse off period (T3) was 0.85. During the treatment, the peak current density on the positive side fluctuated in a range of 0.5 to 40 A/dm$^2$. During the treatment, there was particularly no change in the appearance of the solution or formation of precipitates, and the electrolysis solution was stable.

Example 14

An electrolysis solution was prepared by adding to water water-soluble zirconium potassium carbonate at a concentration in terms of zirconium of 0.050 mol/L (=X), tartrate ions in an amount of 0.0006 mol/L (=Y), potassium carbonate in a carbonate ion amount of 0.20 mol/L (=Z) in combination with the carbonate from the zirconium potassium carbonate, and pyrophosphate ions at a concentration in terms of phosphorus of 0.1 mol/L. To this solution was added a silica particle dispersion containing 0.8 g/L silica particles with an average particle size of 10 to 20 nm to obtain a suspended electrolysis solution. The electrolysis solution was adjusted with potassium hydroxide, tartaric acid, sodium potassium tartrate, pyrophosphoric acid and sodium pyrophosphate to a pH of 9.5. The thus obtained electrolysis solution had an electrical conductivity at 20° C. of 1.8 S/m and the ratios Y/X and Z/X were 0.01 and 4.0, respectively.

This electrolysis solution was adjusted to 20° C. and used. A plate of die casting aluminum alloy (JIS ADC12 material) with a surface area of 1 dm$^2$ and a titanium plate were used as a working electrode and a counter electrode, respectively to perform a bipolar electrolytic treatment for 5 minutes, thereby forming a ceramic film on a surface of the aluminum plate. The surface of the anode during the electrolysis was observed and light emission from the arc discharge and/or glow discharge was found to take place.

The conditions on the bipolar treatment were as follows: The voltage was controlled on both of the positive and negative sides so as to have a square waveform on the positive side and a sinusoidal waveform on the negative side, respectively; the positive and negative peak voltage values were set to 500 V and 100 V, respectively; the duty ratio on the positive side (T1) and that on the negative side (T2) were set to 0.05 and 0.02, respectively; and the frequency was set to 100 Hz. The pulse off period (T3) was 0.93 and the ratios T2/T1 and T3/(T1+T2) were set to 0.4 and 13.3, respectively. During the treatment, the peak current density on the positive side fluctuated in a range of 0.5 to 40 A/dm$^2$. During the treatment, there was particularly no change in the appearance of the solution or formation of precipitates, and the electrolysis solution was stable.

Example 15

An electrolysis solution was prepared by adding to water water-soluble zirconium potassium carbonate at a concentration in terms of zirconium of 0.060 mol/L (=X), citrate ions in an amount of 0.010 mol/L (=Y) and potassium carbonate in a carbonate ion amount of 0.180 mol/L (=Z) in combination with the carbonate from the zirconium potassium carbonate. To this solution was added a silica particle dispersion containing 1.5 g/L silica particles with an average particle size of 15 to 30 nm to obtain a suspended electrolysis solution. The electrolysis solution was adjusted with potassium hydroxide, citric acid and potassium citrate to a pH of 10.5. The thus obtained electrolysis solution had an electrical conductivity at 20° C. of 3.0 S/m and the ratios Y/X and Z/X were 0.17 and 3.0, respectively.

This electrolysis solution was adjusted to 20° C. and used. A plate of die casting aluminum alloy (JIS AC8A material) with a surface area of 1 dm$^2$ and a stainless steel plate were used as a working electrode and a counter electrode, respectively to perform a bipolar electrolytic treatment for 4 minutes, thereby forming a ceramic film on a surface of the aluminum plate. The surface of the anode during the electrolysis was observed and light emission from the arc discharge and/or glow discharge was found to take place.

The conditions on the bipolar treatment were as follows: The voltage was controlled on both of the positive and negative sides so as to have a square waveform on both of the positive and negative sides; the positive and negative peak voltage values were set to 525 V and 150 V, respectively; the duty ratio on the positive side (T1) and that on the negative side (T2) were set to 0.06 and 0.06, respectively; and the frequency was set to 60 Hz. The pulse off period (T3) was 0.88 and the ratios T2/T1 and T3/(T1+T2) were set to 1.0 and 7.3, respectively. During the treatment, the peak current density on the positive side fluctuated in a range of 0.5 to 40 A/dm$^2$. During the treatment, there was particularly no change in the appearance of the solution or formation of precipitates, and the electrolysis solution was stable.

Example 16

An electrolysis solution was prepared by adding to water water-soluble zirconium potassium carbonate at a concentration in terms of zirconium of 0.050 mol/L (=X), tartrate ions in an amount of 0.0030 mol/L (=Y), sodium carbonate in a carbonate ion amount of 0.30 mol/L (=Z) in combination with the carbonate from the zirconium potassium carbonate, and pyrophosphate ions at a concentration in terms of phosphorus of 0.11 mol/L. The electrolysis solution was adjusted with potassium hydroxide, tartaric acid, sodium tartrate, pyrophosphoric acid and sodium pyrophosphate to a pH of 9.7. The thus obtained electrolysis solution had an electrical conductivity at 20° C. of 3.0 S/m and the ratios Y/X and Z/X were 0.06 and 6.0, respectively.

This electrolysis solution was adjusted to 20° C. and used. A plate of die casting aluminum alloy (JIS ADC12 material) with a surface area of 1 dm$^2$ and a stainless steel plate were used as a working electrode and a counter electrode, respectively to perform a bipolar electrolytic treatment for 8 minutes, thereby forming a ceramic film on a surface of the aluminum plate. The surface of the anode during the electrolysis was observed and light emission from the arc discharge and/or glow discharge was found to take place.

The conditions on the bipolar treatment were as follows: The voltage was controlled on both of the positive and negative sides so as to have a square waveform on both of the positive and negative sides; the positive and negative peak voltage values were set to 320 V and 120 V, respectively; the duty ratio on the positive side (T1) and that on the negative side (T2) were set to 0.12 and 0.10, respectively; and the frequency was set to 70 Hz. The pulse off period (T3) was 0.78 and the ratios T2/T1 and T3/(T1+T2) were set to 0.8 and 3.5, respectively. During the treatment, the peak current density on the positive side fluctuated in a range of 0.5 to 40 A/dm$^2$. During the treatment, there was particularly no change in the appearance of the solution or formation of precipitates, and the electrolysis solution was stable.

Example 17

A plate of die casting aluminum alloy (JIS ADC12 material) with a surface area of 1 $dm^2$ and a titanium plate were used as a working electrode and a counter electrode, respectively to electrolyze the aluminum alloy plate in two consecutive steps in different electrolysis solutions under different electrolysis conditions. In both of the steps, a surface of the anode during the electrolysis was observed and light emission from the arc discharge and/or glow discharge was found to take place.

The first step was performed at 5° C. for 2 minutes in the electrolysis solution of Example 11. In the first step, the bipolar treatment was performed under the following electrolysis conditions: The voltage was controlled on both of the positive and negative sides so as to have a sinusoidal waveform on both of the positive and negative sides; the positive and negative peak voltage values were set to 550 V and 80 V, respectively; the duty ratio on the positive side (T1) and that on the negative side (T2) were set to 0.15 and 0.10, respectively; and the frequency was set to 60 Hz. The pulse off period (T3) was 0.75 and the ratios T2/T1 and T3/(T1+T2) were set to 0.7 and 3.0, respectively. During the first step, the peak current density on the positive side fluctuated in a range of 0.5 to 40 $A/dm^2$.

The second step was performed by washing the aluminum plate having undergone the first step with water and immersing the washed aluminum plate in the electrolysis solution of Example 14 at 5° C. for 18 minutes. In the second step, the bipolar treatment was performed under the following electrolysis conditions: The voltage was controlled on both of the positive and negative sides so as to have a sinusoidal waveform on both of the positive and negative sides; the positive and negative peak voltage values were set to 550 V and 80 V, respectively; the duty ratio on the positive side (T1) and that on the negative side (T2) were set to 0.15 and 0.10, respectively; and the frequency was set to 60 Hz. The pulse off period (T3) was 0.75 and the ratios T2/T1 and T3/(T1+T2) were set to 0.7 and 3.0, respectively. During the second step, the peak current density on the positive side fluctuated in a range of 0.5 to 40 $A/dm^2$. During the treatment, there was particularly no change in the appearance of the solution or formation of precipitates, and the electrolysis solution was stable.

Example 18

A plate of die casting aluminum alloy (JIS ADC12 material) with a surface area of 1 $dm^2$ and a stainless steel plate were used as a working electrode and a counter electrode, respectively to electrolyze the aluminum alloy plate in two consecutive steps in different electrolysis solutions under different electrolysis conditions. In both of the steps, a surface of the anode during the electrolysis was observed and light emission from the arc discharge and/or glow discharge was found to take place.

The first step was performed at 4° C. for 5 minutes in the electrolysis solution of Example 3. In the first step, the bipolar treatment was performed under the following electrolysis conditions: The voltage was controlled on both of the positive and negative sides so as to have a square waveform on both of the positive and negative sides; the positive and negative peak voltage values were set to 500 V and 100 V, respectively; the duty ratio on the positive side (T1) and that on the negative side (T2) were set to 0.10 and 0.10, respectively; and the frequency was set to 250 Hz. The pulse off period (T3) was 0.80 and the ratios T2/T1 and T3/(T1+T2) were set to 1.0 and 4.0, respectively. During the first step, the peak current density on the positive side fluctuated in a range of 0.5 to 40 $A/dm^2$.

The second step was performed by washing the aluminum plate having undergone the first step with water and immersing the washed aluminum plate in the electrolysis solution of Example 2 at 40° C. for 5 minutes. In the second step, the bipolar treatment was performed under the following electrolysis conditions: The current was controlled on the positive side, whereas the voltage was controlled on the negative side so as to have a square waveform on both of the positive and negative sides; the positive peak current value were set to 2.3 $A/dm^2$; the negative peak voltage value was set to 100 V; the duty ratio on the positive side (T1) and that on the negative side (T2) were set to 0.10 and 0.10, respectively; and the frequency was set to 250 Hz. The pulse off period (T3) was 0.80 and the ratios T2/T1 and T3/(T1+T2) were set to 1.0 and 4.0, respectively. During the second step, the peak voltage on the positive side fluctuated in a range of 150 to 650 V. During the treatment, there was particularly no change in the appearance of the solution or formation of precipitates, and the electrolysis solution was stable.

Example 19

First of all, the same electrolysis solution as that in Example 11 was used to electrolyze a plate of the same type aluminum alloy (JIS ADC12 material) serving as a working electrode for the same period of time under quite the same electrolysis conditions to prepare an aluminum member having a ceramic film formed therein as in Example 11. A surface of the ceramic film of the aluminum member was polished with emery abrasive paper (grit size: 2,000) and water as a solvent.

Example 20

First of all, the same electrolysis solution as that in Example 11 was used to electrolyze a plate of the same type aluminum alloy (JIS ADC12 material) serving as a working electrode for the same period of time under quite the same electrolysis conditions to prepare an aluminum member having a ceramic film formed therein as in Example 11. A polyamic acid solution was applied to a surface of the ceramic film of the aluminum member and the aluminum member was baked at 280° C. for 10 minutes for sufficient imidization to form a polyimide film with a thickness of 1 μm.

2. Formation of Ceramic Film (Magnesium Member)

Example 21

An electrolysis solution was prepared by adding to water water-soluble zirconium ammonium carbonate at a concentration in terms of zirconium of 0.050 mol/L (=X), citrate ions in an amount of 0.025 mol/L (=Y), ammonium carbonate in a carbonate ion amount of 0.25 mol/L (=Z) in combination with the carbonate from the zirconium ammonium carbonate, and orthophosphate ions at a concentration in terms of phosphorus of 0.06 mol/L. The electrolysis solution was adjusted with potassium hydroxide, sodium citrate, citric acid, orthophosphoric acid and sodium orthophosphate to a pH of 13.2. The thus obtained electrolysis solution had an electrical conductivity at 10° C. of 3.2 S/m and the ratios Y/X and Z/X were 0.50 and 5.0, respectively.

This electrolysis solution was adjusted to 10° C. and used. A plate of die casting magnesium alloy (JIS AZ91D material) with a surface area of 1 $dm^2$ and a titanium plate were used as a working electrode and a counter electrode, respectively to perform a bipolar electrolytic treatment for 10 minutes, thereby forming a ceramic film on a surface of the magnesium plate. The surface of the anode during the electrolysis was observed and light emission from the arc discharge and/or glow discharge was found to take place.

The conditions on the bipolar treatment were as follows: The voltage was controlled on both of the positive and negative sides to have a square waveform; the positive and negative peak voltage values were set to 450 V and 100 V, respectively; the duty ratio on the positive side (T1) and that on the negative side (T2) were set to 0.10 and 0.08, respectively; and the frequency was set to 1,200 Hz. The pulse off period (T3) was 0.82 and the ratios T2/T1 and T3/(T1+T2) were set to 0.8 and 4.6, respectively. During the treatment, the peak current density on the positive side fluctuated in a range of 0.5 to 40 $A/dm^2$. During the treatment, there was particularly no change in the appearance of the solution or formation of precipitates, and the electrolysis solution was stable.

Example 22

An electrolysis solution was prepared by adding to water water-soluble zirconium potassium carbonate at a concentration in terms of zirconium of 0.009 mol/L (=X), tartrate ions in an amount of 0.011 mol/L (=Y), sodium carbonate in a carbonate ion amount of 0.038 mol/L (=Z) in combination with the carbonate from the zirconium potassium carbonate, and orthophosphate ions at a concentration in terms of phosphorus of 0.02 mol/L. The electrolysis solution was adjusted with potassium hydroxide, sodium potassium tartrate, tartaric acid, orthophosphoric acid and sodium orthophosphate to a pH of 12.8. The thus obtained electrolysis solution had an electrical conductivity at 16° C. of 2.5 S/m and the ratios Y/X and Z/X were 1.22 and 4.2, respectively.

This electrolysis solution was adjusted to 16° C. and used. A plate of die casting magnesium alloy (JIS AZ91D material) with a surface area of 1 $dm^2$ and a stainless steel plate were used as a working electrode and a counter electrode, respectively to perform a bipolar electrolytic treatment for 3 minutes, thereby forming a ceramic film on a surface of the magnesium plate. The surface of the anode during the electrolysis was observed and light emission from the arc discharge and/or glow discharge was found to take place.

The conditions on the bipolar treatment were as follows: The voltage was controlled on both of the positive and negative sides so as to have a square waveform; the positive and negative peak voltage values were set to 500 V and 80 V, respectively; the duty ratio on the positive side (T1) and that on the negative side (T2) were set to 0.12 and 0.12, respectively; and the frequency was set to 60 Hz. The pulse off period (T3) was 0.76 and the ratios T2/T1 and T3/(T1+T2) were set to 1.0 and 3.2, respectively. During the treatment, the peak current density on the positive side fluctuated in a range of 0.5 to 40 $A/dm^2$. During the treatment, there was particularly no change in the appearance of the solution or formation of precipitates, and the electrolysis solution was stable.

Example 23

An electrolysis solution was prepared by adding to water water-soluble zirconium potassium carbonate at a concentration in terms of zirconium of 0.0007 mol/L (=X), tartrate ions in an amount of 0.020 mol/L (=Y), potassium carbonate in a carbonate ion amount of 0.0034 mol/L (=Z) in combination with the carbonate from the zirconium potassium carbonate, orthophosphate ions at a concentration in terms of phosphorus of 0.03 mol/L, and sodium aluminate in an amount of 0.061 mol/L. The electrolysis solution was adjusted with potassium hydroxide, sodium potassium tartrate, tartaric acid, orthophosphoric acid and sodium orthophosphate to a pH of 13.0. The thus obtained electrolysis solution had an electrical conductivity at 21° C. of 2.8 S/m and the ratios Y/X and Z/X were 28.57 and 4.9, respectively.

This electrolysis solution was adjusted to 21° C. and used. A plate of die casting magnesium alloy (JIS AZ91D material) with a surface area of 1 $dm^2$ and a stainless steel plate were used as a working electrode and a counter electrode, respectively to perform a bipolar electrolytic treatment for 3 minutes, thereby forming a ceramic film on a surface of the magnesium plate. The surface of the anode during the electrolysis was observed and light emission from the arc discharge and/or glow discharge was found to take place.

The conditions on the bipolar treatment were as follows: The voltage was controlled on both of the positive and negative sides so as to have a sinusoidal waveform; the positive and negative peak voltage values were set to 500 V and 80 V, respectively; the duty ratio on the positive side (T1) and that on the negative side (T2) were set to 0.12 and 0.12, respectively; and the frequency was set to 60 Hz. The pulse off period (T3) was 0.76 and the ratios T2/T1 and T3/(T1+T2) were set to 1.0 and 3.2, respectively. During the treatment, the peak current density on the positive side fluctuated in a range of 0.5 to 40 $A/dm^2$. During the treatment, there was particularly no change in the appearance of the solution or formation of precipitates, and the electrolysis solution was stable.

Example 24

An electrolysis solution was prepared by adding to water water-soluble zirconium ammonium carbonate at a concentration in terms of zirconium of 0.015 mol/L (=X), citrate ions in an amount of 0.050 mol/L (=Y), sodium carbonate in a carbonate ion amount of 0.18 mol/L (=Z) in combination with the carbonate from the zirconium ammonium carbonate, and pyrophosphate ions at a concentration in terms of phosphorus of 0.15 mol/L. The electrolysis solution was adjusted with sodium hydroxide, potassium citrate, citric acid, pyrophosphoric acid and sodium pyrophosphate to a pH of 12.6. The thus obtained electrolysis solution had an electrical conductivity at 4° C. of 1.8 S/m and the ratios Y/X and Z/X were 3.33 and 12.0, respectively.

This electrolysis solution was adjusted to 4° C. and used. A plate of die casting magnesium alloy (JIS AM60B material) with a surface area of 1 $dm^2$ and a titanium plate were used as a working electrode and a counter electrode, respectively to perform a two-step electrolytic treatment including the first monopolar electrolysis process and its subsequent bipolar electrolysis process for a total period of 8 minutes, thereby forming a ceramic film on a surface of the magnesium plate. The surface of the anode during the treatment was observed in the two-step electrolytic treatment and light emission from the arc discharge and/or glow discharge was found to take place.

The first monopolar electrolysis process was performed for 3 minutes under the following conditions: No application was made to the negative side; the voltage was controlled only on the positive side so as to have a sinusoidal waveform; the positive peak voltage value was set to 450 V; the duty ratio (T1) was set to 0.15 and the frequency was set to 200 Hz. The pulse off period (T3) was 0.85. During the first step, the peak current density on the positive side fluctuated in a range of 0.5 to 40 A/dm$^2$.

The second step was performed for 5 minutes under the following conditions: The voltage was controlled on both of the positive and negative sides so as to have a sinusoidal waveform; the positive and negative peak voltage values were set to 550 V and 130 V, respectively; the duty ratio on the positive side (T1) and that on the negative side (T2) were set to 0.12 and 0.12, respectively; and the frequency was set to 200 Hz. The pulse off period (T3) was 0.80 and the ratios T2/T1 and T3/(T1+T2) were set to 1.0 and 3.2, respectively. During the second step, the peak current density on the positive side fluctuated in a range of 0.5 to 40 A/dm$^2$. During the treatment, there was particularly no change in the appearance of the solution or formation of precipitates, and the electrolysis solution was stable.

Example 25

An electrolysis solution was prepared by adding to water water-soluble zirconium ammonium carbonate at a concentration in terms of zirconium of 0.010 mol/L (=X), citrate ions in an amount of 0.050 mol/L (=Y), ammonium carbonate in a carbonate ion amount of 0.070 mol/L (=Z) in combination with the carbonate from the zirconium ammonium carbonate, and orthophosphate ions at a concentration in terms of phosphorus of 0.8 mol/L. The electrolysis solution was adjusted with lithium hydroxide, potassium citrate, citric acid, orthophosphoric acid and sodium orthophosphate to a pH of 12.9. The thus obtained electrolysis solution had an electrical conductivity at 5° C. of 3.5 S/m and the ratios Y/X and Z/X were 5.00 and 7.0, respectively.

This electrolysis solution was adjusted to 5° C. and used. A plate of wrought magnesium (JIS AZ31 material) with a surface area of 1 dm$^2$ and a titanium plate were used as a working electrode and a counter electrode, respectively to perform a bipolar electrolytic treatment for 20 minutes, thereby forming a ceramic film on a surface of the magnesium plate. The surface of the anode during the electrolysis was observed and light emission from the arc discharge and/or glow discharge was found to take place.

The conditions on the bipolar treatment were as follows: The current was controlled on the positive side, whereas the voltage was controlled on the negative side so as to have a sinusoidal waveform on the positive side and a triangular waveform on the negative side, respectively; the positive peak current value was set to 3 A/dm$^2$; the negative peak voltage value was set to 100 V; the duty ratio on the positive side (T1) and that on the negative side (T2) were set to 0.08 and 0.01, respectively; and the frequency was set to 100 Hz. The pulse off period (T3) was 0.91 and the ratios T2/T1 and T3/(T1+T2) were set to 0.1 and 10.1, respectively. During the treatment, the peak voltage on the positive side fluctuated in a range of 150 to 650 V. During the treatment, there was particularly no change in the appearance of the solution or formation of precipitates, and the electrolysis solution was stable.

Example 26

A plate of die casting magnesium alloy (JIS ZK61A material) with a surface area of 1 dm$^2$ and a titanium plate were used as a working electrode and a counter electrode, respectively to electrolyze the magnesium alloy plate in two consecutive steps in different electrolysis solutions under different electrolysis conditions. In both of the steps, a surface of the anode during the electrolysis was observed and light emission from the arc discharge and/or glow discharge was found to take place.

The first step was performed at 21° C. for 2 minutes in the electrolysis solution of Example 23. In the first step, the bipolar treatment was performed under the following electrolysis conditions: The voltage was controlled on both of the positive and negative sides so as to have a sinusoidal waveform on both of the positive and negative sides; the positive and negative peak voltage values were set to 500 V and 80 V, respectively; the duty ratio on the positive side (T1) and that on the negative side (T2) were set to 0.12 and 0.12, respectively; and the frequency was set to 60 Hz. The pulse off period (T3) was 0.76 and the ratios T2/T1 and T3/(T1+T2) were set to 1.0 and 3.2, respectively. During the first step, the peak current density on the positive side fluctuated in a range of 0.5 to 40 A/dm$^2$.

The second step was performed by washing the magnesium plate having undergone the first step with water and immersing the washed magnesium plate in the electrolysis solution of Example 22 at 16° C. for 2 minutes. In the second step, the bipolar treatment was performed under the following electrolysis conditions: The voltage was controlled on both of the positive and negative sides so as to have a square waveform on both of the positive and negative sides; the positive and negative peak voltage values were set to 500 V and 80 V, respectively; the duty ratio on the positive side (T1) and that on the negative side (T2) were set to 0.12 and 0.12, respectively; and the frequency was set to 60 Hz. The pulse off period (T3) was 0.76 and the ratios T2/T1 and T3/(T1+T2) were set to 1.0 and 3.2, respectively. During the second step, the peak current density on the positive side fluctuated in a range of 0.5 to 40 A/dm$^2$. During the treatment, there was particularly no change in the appearance of the solution or formation of precipitates, and the electrolysis solution was stable.

Example 27

An electrolysis solution was prepared by adding to water water-soluble zirconium potassium carbonate at a concentration in terms of zirconium of 0.003 mol/L (=X), ascorbate ions in an amount of 0.020 mol/L (=Y), sodium carbonate in a carbonate ion amount of 0.016 mol/L (=Z) in combination with the carbonate from the zirconium potassium carbonate, and orthophosphate ions at a concentration in terms of phosphorus of 0.04 mol/L. To this solution was added a zirconium oxide particle dispersion containing 1.5 g/L zirconium oxide particles with an average particle size of 20 to 40 nm to obtain a suspended electrolysis solution. The electrolysis solution was adjusted with potassium hydroxide, sodium ascorbate, ascorbic acid, orthophosphoric acid and sodium orthophosphate to a pH of 13.3. The thus obtained electrolysis solution had an electrical conductivity at 16° C. of 3.1 S/m and the ratios Y/X and Z/X were 6.67 and 5.3, respectively.

This electrolysis solution was adjusted to 16° C. and used. A plate of die casting magnesium alloy (JIS EZ33 material) with a surface area of 1 dm$^2$ and a titanium plate were used as a working electrode and a counter electrode, respectively to perform a bipolar electrolytic treatment for 10 minutes, thereby forming a ceramic film on a surface of the magnesium plate. The surface of the anode during the electrolysis was observed and light emission from the arc discharge and/or glow discharge was found to take place.

The conditions on the bipolar treatment were as follows: The voltage was controlled on both of the positive and negative sides so as to have a square waveform on both of the positive and negative sides; the positive and negative peak voltage values were set to 550 V and 100 V, respectively; the duty ratio on the positive side (T1) and that on the negative side (T2) were set to 0.12 and 0.12, respectively; and the frequency was set to 500 Hz. The pulse off period (T3) was 0.76 and the ratios T2/T1 and T3/(T1+T2) were set to 1.0 and 3.2, respectively. During the treatment, the peak current density on the positive side fluctuated in a range of 0.5 to 40 A/dm$^2$. During the treatment, there was particularly no change in the appearance of the solution or formation of precipitates, and the electrolysis solution was stable.

Example 28

First of all, the same electrolysis solution as that in Example 22 was used to electrolyze a plate of the same type die casting magnesium alloy (JIS AZ91D material) serving as a working electrode for the same period of time under quite the same electrolysis conditions to prepare a magnesium member having a ceramic film formed therein as in Example 22. A surface of the ceramic film of the magnesium member was polished in a polishing machine using an alumina abrasive.

Example 29

First of all, the same electrolysis solution as that in Example 22 was used to electrolyze a plate of the same type die casting magnesium alloy (JIS AZ91D material) serving as a working electrode for the same period of time under quite the same electrolysis conditions to prepare a magnesium member having a ceramic film formed therein as in Example 22. A dispersion of polytetrafluoroethylene (PTFE) with an average particle size of 0.25 μm was applied to a surface of the ceramic film of the magnesium member and dried to form a lubricating film with a thickness of about 0.5 μm on the surface of the ceramic film.

3. Formation of Ceramic Film (Titanium Member)

Example 30

An electrolysis solution was prepared by adding to water water-soluble zirconium potassium carbonate at a concentration in terms of zirconium of 0.005 mol/L (=X), citrate ions in an amount of 0.10 mol/L (=Y), sodium carbonate in a carbonate ion amount of 0.07 mol/L (=Z) in combination with the carbonate from the zirconium potassium carbonate, and orthophosphate ions at a concentration in terms of phosphorus of 0.03 mol/L. The electrolysis solution was adjusted with potassium hydroxide, sodium citrate, citric acid, orthophosphoric acid and sodium orthophosphate to a pH of 13.4. The thus obtained electrolysis solution had an electrical conductivity at 19° C. of 4.1 S/m and the ratios Y/X and Z/X were 20.0 and 14.0, respectively.

This electrolysis solution was adjusted to 19° C. and used. A plate of pure titanium (JIS type 2) with a surface area of 1 dm$^2$ and a stainless steel plate were used as a working electrode and a counter electrode, respectively to perform a bipolar electrolytic treatment for 20 minutes, thereby forming a ceramic film on a surface of the titanium plate. The surface of the anode during the electrolysis was observed and light emission from the arc discharge and/or glow discharge was found to take place.

The conditions on the bipolar treatment were as follows: The voltage was controlled on both of the positive and negative sides so as to have a square waveform on both of the positive and negative sides; the positive and negative peak voltage values were set to 350 V and 200 V, respectively; the duty ratio on the positive side (T1) and that on the negative side (T2) were set to 0.12 and 0.02, respectively; and the frequency was set to 100 Hz. The pulse off period (T3) was 0.86 and the ratios T2/T1 and T3/(T1+T2) were set to 0.2 and 6.1, respectively. During the treatment, the peak current density on the positive side fluctuated in a range of 0.5 to 40 A/dm$^2$. During the treatment, there was particularly no change in the appearance of the solution or formation of precipitates, and the electrolysis solution was stable.

Example 31

An electrolysis solution was prepared by adding to water water-soluble zirconium potassium carbonate at a concentration in terms of zirconium of 0.041 mol/L (=X), tartrate ions in an amount of 0.02 mol/L (=Y) and potassium carbonate in a carbonate ion amount of 0.102 mol/L (=Z) in combination with the carbonate from the zirconium potassium carbonate. The electrolysis solution was adjusted with potassium hydroxide, sodium tartrate and tartaric acid to a pH of 12.8. The thus obtained electrolysis solution had an electrical conductivity at 20° C. of 2.2 S/m and the ratios Y/X and Z/X were 0.49 and 2.5, respectively.

This electrolysis solution was adjusted to 20° C. and used. A plate of titanium alloy material (JIS type 60, 6Al-4V-Ti) with a surface area of 1 dm$^2$ and a stainless steel plate were used as a working electrode and a counter electrode, respectively to perform a bipolar electrolytic treatment for 6 minutes, thereby forming a ceramic film on a surface of the titanium plate. The surface of the anode during the electrolysis was observed and light emission from the arc discharge and/or glow discharge was found to take place.

The conditions on the bipolar treatment were as follows: The voltage was controlled on both of the positive and negative sides so as to have a sinusoidal waveform on both of the positive and negative sides; the positive and negative peak voltage values were set to 450 V and 110 V, respectively; the duty ratio on the positive side (T1) and that on the negative side (T2) were set to 0.12 and 0.12, respectively; and the frequency was set to 60 Hz. The pulse off period (T3) was 0.76 and the ratios T2/T1 and T3/(T1+T2) were set to 1.0 and 3.2, respectively. During the treatment, the peak current density on the positive side fluctuated in a range of 0.5 to 40 A/dm$^2$. During the treatment, there was particularly no change in the appearance of the solution or formation of precipitates, and the electrolysis solution was stable.

Example 32

An electrolysis solution was prepared by adding to water water-soluble zirconium potassium carbonate at a concentration in terms of zirconium of 0.10 mol/L (=X), tartrate ions in an amount of 0.04 mol/L (=Y) and potassium carbonate in a carbonate ion amount of 0.40 mol/L (=Z) in combination with the carbonate from the zirconium potassium carbonate. The electrolysis solution was adjusted with potassium hydroxide, sodium tartrate and tartaric acid to a pH of 7.8. The thus obtained electrolysis solution had an electrical conductivity at 20° C. of 3.1 S/m and the ratios Y/X and Z/X were 0.40 and 4.0, respectively.

This electrolysis solution was adjusted to 20° C. and used. A plate of titanium/aluminum alloy material (aluminum content: 14 atom %) with a surface area of 1 dm$^2$ and a stainless steel plate were used as a working electrode and a counter electrode, respectively to perform a bipolar electrolytic treatment for 12 minutes, thereby forming a ceramic film on a surface of the titanium plate. The surface of the anode during the electrolysis was observed and light emission from the arc discharge and/or glow discharge was found to take place.

The conditions on the bipolar treatment were as follows: The voltage was controlled on both of the positive and negative sides so as to have a sinusoidal waveform on both of the positive and negative sides; the positive and negative peak voltage values were set to 500 V and 110 V, respectively; the duty ratio on the positive side (T1) and that on the negative side (T2) were set to 0.08 and 0.08, respectively; and the frequency was set to 200 Hz. The pulse off period (T3) was 0.84 and the ratios T2/T1 and T3/(T1+T2) were set to 1.0 and 5.3, respectively. During the treatment, the peak current density on the positive side fluctuated in a range of 0.5 to 40 A/dm$^2$. During the treatment, there was particularly no change in the appearance of the solution or formation of precipitates, and the electrolysis solution was stable.

Comparative Examples

In Comparative Examples 1 to 3 illustrated below, an electrolytic treatment was performed under the same electrolysis conditions as those in Example 11 but some of the ingredients contained in the electrolysis solutions used were different from in Example 11. More specifically, the content of the complexing agent in Comparative Example 1 was outside the scope of the invention, the carbonate ion content in Comparative Example 2 was outside the scope of the invention, and no arc discharge occurred in Comparative Example 3 because of the low electrical conductivity.

Comparative Example 1

The electrolysis solution of Example 11 from which the complexing agent was excluded was used, and the electrolysis conditions and the substrate were the same as those in Example 11. More specifically, the electrolysis solution was prepared by adding to water water-soluble zirconium potassium carbonate at a concentration in terms of zirconium of 0.020 mol/L (=X), potassium carbonate in a carbonate ion amount of 0.14 mol/L (=Z) in combination with the carbonate from the zirconium potassium carbonate, and orthophosphate ions at a concentration in terms of phosphorus of 0.06 mol/L. The electrolysis solution was adjusted with sodium hydroxide, orthophosphoric acid and potassium orthophosphate to a pH of 11.0. The thus obtained electrolysis solution had an electrical conductivity at 5° C. of 1.2 S/m and the ratios Y/X and Z/X were 0 and 7.0, respectively.

The electrolysis solution was adjusted to 5° C. and used. A plate of die casting aluminum alloy (JIS ADC12 material) with a surface area of 1 dm$^2$ and a stainless steel plate were used as a working electrode and a counter electrode, respectively to perform a bipolar electrolytic treatment for 20 minutes under quite the same electrolysis conditions as those in Example 11, thereby forming a ceramic film on a surface of the aluminum plate. The surface of the anode during the electrolysis was observed and light emission from the arc discharge and/or glow discharge was found to take place. During the treatment, the peak current density on the positive side fluctuated in a range of 0.5 to 40 A/dm$^2$. However, whitish substances were suspended in the electrolysis solution during the treatment and adhered to the ceramic film, thus forming tangible bosses in places on the film.

Comparative Example 2

The electrolysis conditions and substrate used were the same as those in Example 11 except that the contents of the complexing agent and carbonic acid in the electrolysis solution were lower than those in Example 11. More specifically, the electrolysis solution was prepared by adding to water water-soluble zirconium potassium carbonate at a concentration in terms of zirconium of 0.020 mol/L (=X), tartrate ions in an amount of 0.0001 mol/L (=Y), and orthophosphate ions at a concentration in terms of phosphorus of 0.06 mol/L. Potassium carbonate was not particularly added and the electrolysis solution contained carbonate ions from the zirconium potassium carbonate in an amount of 0.040 mol/L (=Z). The electrolysis solution was adjusted with sodium hydroxide, sodium potassium tartrate, tartaric acid, orthophosphoric acid and potassium orthophosphate to a pH of 11.0. The thus obtained electrolysis solution had an electrical conductivity at 10° C. of 1.0 S/m and the ratios Y/X and Z/X were 0.01 and 2.0, respectively.

The electrolysis solution was adjusted to 10° C. and used. A plate of die casting aluminum alloy (JIS ADC12 material) with a surface area of 1 dm$^2$ and a stainless steel plate were used as a working electrode and a counter electrode, respectively to perform a bipolar electrolytic treatment for 20 minutes under quite the same electrolysis conditions as those in Example 11, thereby forming a ceramic film on a surface of the aluminum plate. The surface of the anode during the electrolysis was observed and light emission from the arc discharge and/or glow discharge was found to take place. During the treatment, the peak current density on the positive side fluctuated in a range of 0.5 to 40 A/dm$^2$. During the treatment, there was particularly no change in the appearance of the solution or formation of precipitates, and the electrolysis solution was stable.

Comparative Example 3

The zirconium content, complexing agent content and carbonate ion content in the electrolysis solution were set to one-tenth of those in Example 11. More specifically, the electrolysis solution was prepared by adding to water water-soluble zirconium potassium carbonate at a concentration in terms of zirconium of 0.0020 mol/L (=X), tartrate ions in an amount of 0.00050 mol/L (=Y), potassium carbonate in a carbonate ion amount of 0.014 mol/L (=Z) in combination with the carbonate from the zirconium potassium carbonate, and orthophosphate ions at a concentration in terms of phosphorus of 0.006 mol/L. The electrolysis solution was adjusted with sodium hydroxide, sodium potassium tartrate, tartaric acid, orthophosphoric acid and potassium orthophosphate to a pH of 7.3. The thus obtained electrolysis solution had an electrical conductivity at 5° C. of 0.18 S/m and the ratios Y/X and Z/X were 0.25 and 7.0, respectively.

The electrolysis solution was adjusted to 5° C. and used. A plate of die casting aluminum alloy (JIS ADC12 material) with a surface area of 1 dm$^2$ and a stainless steel plate were used as a working electrode and a counter electrode, respectively to perform a bipolar electrolytic treatment for 20 minutes under quite the same electrolysis conditions as those in Example 11. A surface of the anode during the electrolysis was observed and light emission from the arc discharge and/or glow discharge was not found to take place, nor was a ceramic film formed on the surface of the aluminum plate. During the treatment, the peak current density on the positive side was often less than 0.5 A/dm$^2$. During the treatment, there was particularly no change in the appearance of the solution or formation of precipitates, and the electrolysis solution was stable.

Comparative Example 5

The same electrolysis solution and substrate as those in Example 11 were used and, of the electrolysis conditions, the duty ratio was only different. More specifically, the same electrolysis solution as that in Example 11 was adjusted to 5° C. and used. A plate of die casting aluminum alloy (JIS ADC12 material) with a surface area of 1 $dm^2$ and a stainless steel plate were used as a working electrode and a counter electrode, respectively to perform a bipolar electrolytic treatment for 20 minutes. A surface of the anode during the electrolysis was observed and light emission from the arc discharge and/or glow discharge was not found to take place.

The conditions on the bipolar treatment were as follows: The voltage was controlled on both of the positive and negative sides so as to have a sinusoidal waveform; the positive and negative peak voltage values were set to 550 V and 80 V, respectively; the duty ratio on the positive side (T1) and that on the negative side (T2) were set to 0.04 and 0.50, respectively; and the frequency was set to 60 Hz. The pulse off period (T3) was 0.46 and the ratios T2/T1 and T3/(T1+T2) were set to 12.5 and 0.9, respectively. No ceramic film was formed on the surface of the aluminum plate. During the treatment, there was particularly no change in the appearance of the solution or formation of precipitates, and the electrolysis solution was stable.

Comparative Example 6

The same electrolysis solution and substrate as those in Example 11 were used and, of the electrolysis conditions, the control on the positive side was only different. More specifically, the same electrolysis solution as that in Example 11 was adjusted to 5° C. and used. A plate of die casting aluminum alloy (JIS ADC12 material) with a surface area of 1 $dm^2$ and a stainless steel plate were used as a working electrode and a counter electrode, respectively to perform a bipolar electrolytic treatment for 20 minutes. A surface of the anode during the electrolysis was observed and light emission from the arc discharge and/or glow discharge was not found to take place.

The conditions on the bipolar treatment were as follows: The voltage was controlled on both of the positive and negative sides so as to have a sinusoidal waveform; the positive and negative peak voltage values were set to 140 V and 80 V, respectively; the duty ratio on the positive side (Ti) and that on the negative side (T2) were set to 0.15 and 0.10, respectively; and the frequency was set to 60 Hz. The pulse off period (T3) was 0.75 and the ratios T2/T1 and T3/(T1+T2) were set to 0.7 and 3.0, respectively. No ceramic film was formed on the surface of the aluminum plate. During the treatment, there was particularly no change in the appearance of the solution or formation of precipitates, and the electrolysis solution was stable.

Comparative Examples 7 to 14 refer to the following surface treatments: PEO treatment using no zirconium (Comparative Examples 8, 10 and 11), anodization which does not involve the generation of glow discharge and/or arc discharge (Comparative Examples 9, 12, 13), chemical conversion treatment which is a different surface treatment from electrolysis means (Comparative Example 7) and high temperature oxidation (Comparative Example 14).

Comparative Example 7

ALCHROM 3703 available from Nihon Parkerizing Co., Ltd. was applied to a plate of die casting aluminum alloy (JIS ADC12 material) to form a chromate conversion film with a chromium coating weight of 20 $mg/m^2$.

Comparative Example 8

The electrolysis solution of Example 11 from which the zirconium compound was excluded was used, and the electrolysis conditions and the substrate were quite the same as those in Example 11. More specifically, the electrolysis solution contained tartrate ions in an amount of 0.0050 mol/L (=Y), potassium carbonate in a carbonate ion amount of 0.14 mol/L (=Z), and orthophosphate ions in an amount of 0.06 mol/L. The electrolysis solution was adjusted with sodium hydroxide, sodium potassium tartrate, tartaric acid, orthophosphoric acid and potassium orthophosphate to a pH of 11.0. The thus obtained electrolysis solution had an electrical conductivity at 20° C. of 1.3 S/m.

The electrolysis solution was adjusted to 20° C. and used. A plate of die casting aluminum alloy (JIS ADC12 material) with a surface area of 1 $dm^2$ and a stainless steel plate were used as a working electrode and a counter electrode, respectively to perform a bipolar electrolytic treatment for 20 minutes, thereby forming a ceramic film on a surface of the aluminum plate. The surface of the anode during the electrolysis was observed and light emission from the arc discharge and/or glow discharge was found to take place. During the treatment, the peak current density on the positive side fluctuated in a range of 0.5 to 40 $A/dm^2$. During the treatment, there was particularly no change in the appearance of the solution or formation of precipitates, and the electrolysis solution was stable.

Comparative Example 9

A 10 wt % sulfuric acid bath was used at 5° C. to perform as a common alumite treatment a 30-minute DC electrolysis at 3 $A/dm^2$ using a plate of die casting aluminum alloy (JIS ADC12 material) with a surface area of 1 $dm^2$ and a stainless steel plate as a working electrode and a counter electrode, respectively, whereby a surface of the aluminum plate was anodized. The surface of the anode during the electrolysis was observed and light emission from the arc discharge and/or glow discharge was not found to take place.

Comparative Example 10

The electrolysis solution contained 4 g/L of sodium metasilicate, 5 g/L of monosodium dihydrogen orthophosphate and 2 g/L of potassium hydroxide. The thus obtained electrolysis solution had a pH of 9.0 and an electrical conductivity of 0.9 S/m at 20° C.

The electrolysis solution was adjusted to 20° C. and used. A plate of die casting aluminum alloy (JIS ADC12 material) with a surface area of 1 $dm^2$ and a stainless steel plate were used as a working electrode and a counter electrode, respectively to perform a bipolar electrolytic treatment for 20 minutes under quite the same electrolysis conditions as those in Example 11, thereby forming a ceramic film on a surface of the aluminum plate. The surface of the anode during the electrolysis was observed and light emission from the arc discharge and/or glow discharge was found to take place. During the treatment, the peak current density on the positive side fluctuated in a range of 0.5 to 40 $A/dm^2$. The solution which was transparent at the beginning of the treatment turned slightly whitish after the treatment.

Comparative Example 11

The electrolysis solution contained 7 g/L of sodium metasilicate, 5 g/L of sodium orthophosphate and 5 g/L of potassium hydroxide. The thus obtained electrolysis solution had a pH of 13.1 and an electrical conductivity of 2.3 S/m at 20° C.

The electrolysis solution was adjusted to 20° C. and used. A plate of die casting magnesium alloy (JIS AZ91D material)

with a surface area of 1 $dm^2$ and a stainless steel plate were used as a working electrode and a counter electrode, respectively to perform a bipolar electrolytic treatment for 20 minutes under quite the same electrolysis conditions as in Example 22, thereby forming a ceramic film on a surface of the magnesium plate. The surface of the anode during the electrolysis was observed and light emission from the arc discharge and/or glow discharge was found to take place. During the treatment, the peak current density on the positive side fluctuated in a range of 0.5 to 40 $A/dm^2$. During the treatment, there was particularly no change in the appearance of the solution or formation of precipitates, and the electrolysis solution was stable.

Comparative Example 12

A 20-minute DC electrolysis was performed at 1 $A/dm^2$ in an HAE bath (JIS type 11) using a plate of die casting magnesium alloy (JIS AZ91D material) with a surface area of 1 $dm^2$ and a stainless steel plate as a working electrode and a counter electrode, respectively, whereby a surface of the magnesium plate was anodized. The surface of the anode during the electrolysis was observed and light emission from the arc discharge and/or glow discharge was not found to take place.

Comparative Example 13

A 20-minute DC electrolysis was performed at 1 $A/dm^2$ in a Dow 17 bath (JIS type 12) at a solution temperature of 70° C. using a plate of die casting magnesium alloy (JIS AZ91D material) with a surface area of 1 $dm^2$ and a stainless steel plate as a working electrode and a counter electrode, respectively, whereby a surface of the magnesium plate was anodized. The surface of the anode during the electrolysis was observed and light emission from the arc discharge and/or glow discharge was not found to take place.

Comparative Example 14

A plate of titanium alloy material (JIS type 60) with a surface area of 1 $dm^2$ was put in an oven at 800° C. in an atmospheric environment and subjected to a 3-hour high temperature oxidation. After the heat treatment, the plate was distorted.

The ingredients of the electrolysis solutions and the electrolysis conditions in Examples 1 to 32 and Comparative Examples 1 to 14 are shown in Tables 2 and 3.

5. Evaluation of Solution Stability

The electrolysis solutions used in Examples 1 to 3, 5, 6, 8 to 16, 21 to 25, 27, 30 to 32 and Comparative Examples 1 to 14 were evaluated for the two properties: the stability during the electrolytic treatment and the stability with time when they were left to stand. The stability during the electrolytic treatment was evaluated by visually checking the appearance of the solutions after the electrolytic treatment and the stability with time of the solutions left to stand was evaluated by visually checking the appearance of the solutions after one-month storage at 40° C. Based on the initial state, the solution was rated "good" when there was no particular change, "fair" when slight suspension or precipitation occurred and "poor" when considerable suspension or precipitation occurred. The results are shown in Table 1.

6. Evaluation of Appearance

The color and state of the ceramic film was checked visually and by touching with a finger. The film was rated "poor" when it came off in powder or in flakes upon touching with a finger, tangible projections were formed in places or the appearance was not uniform, and "good" when the film had a uniform appearance, was not powdery and had no abnormalities such as projections. The results are shown in Tables 4 and 5.

The ceramic films having good solution stability and normal appearance were evaluated for the following items 7 to 14.

7. Film Thickness

The thickness of the resulting ceramic film was measured by an eddy-current coating thickness tester (Kett Electric Laboratory). The film which was powdery or was not smooth due to projections was deemed to be unmeasurable and rated "difficult." The results are shown in Tables 4 and 5.

8. Centerline Mean Roughness

The centerline mean roughness (Ra according to JIS) of the surface of the resulting ceramic film was measured by a surface texture and contour measuring instrument (Tokyo Seimitsu Co., Ltd.). The results are shown in Tables 4 and 5.

9. Vickers Hardness

The Vickers hardness of the surface of the resulting film was measured by a micro-Vickers hardness tester (Akashi Corporation) under the load of 10 g. The hardness was measured at ten points and the average of the measurements was adopted. The results are shown in Tables 4 and 5.

10. Determination of Zirconium Content

In order to determine the zirconium content in the ceramic film, an X-ray microanalyzer "EPMA-1610" available from Shimadzu Corporation was used to analyze the chemical composition of the central portion and the uppermost surface portion sampled from the cross-sectional surface of the film. The average of the zirconium contents at the two points was calculated as the zirconium content in the ceramic film. The results are shown in Tables 4 and 5.

11. Evaluation of Adhesion

The Dupont impact test was conducted by dropping a weight of 300 g from a height of 15 cm onto the substrate coated with the ceramic film (pressure was applied to an area with a diameter of 10 mm). After the impact was applied to the substrate, the area was taped and the tape was peeled off to evaluate the adhesion of the film in the following four levels: excellent, good, fair and poor. The sample was rated "excellent" when the film did not peel off at all and "poor" when it considerably peeled off. The bending of the ceramic film following the elastic deformation or plastic deformation of the substrate metal due to the dropping action and the resistance to impact of the ceramic film were taken into account in the measurement of the adhesion. The results are shown in Tables 4 and 5.

12. Evaluation of Sliding Properties

The aluminum material and the magnesium material used for the substrate were ADC12 material and AZ91D material, respectively, and the ceramic films obtained in Examples 8, 9, 11, 12, 14, 16 to 23 and 28 to 32 and Comparative Examples 7 to 14 were subjected to a friction and wear test using a reciprocating sliding-type surface property tester (Shinto Scientific Co., Ltd.) to measure the coefficient of friction and the wear track area of the counterpart member. In the friction and wear test, a SUJ2 steel ball with a diameter of 10 mm was used as the counterpart member. The friction and wear test was conducted without using a lubricant under the following conditions: load applied: 100 g; sliding speed: 1,500 mm/min; number of reciprocating sliding cycles: 500. The depth of wear of the ceramic film after the friction and wear test was measured by a surface texture and contour measuring instrument.

The results of the coefficient of friction, likelihood of attacking the counterpart member and the depth of wear of the film are shown in Tables 4 and 5. The likelihood of attacking the counterpart member was evaluated in four levels of excellent, good, fair and poor in order of increasing area of wear of the counterpart member.

13. Evaluation of Corrosion Resistance of Ceramic Film

The corrosion resistance of the resulting ceramic film itself was determined by a salt spray test (JIS Z 2371). The corrosion resistance of the member is different depending on the type of alloy used for the substrate and therefore the substrate used was made of ADC12 material as the aluminum material or AZ91D material as the magnesium material. In Examples 8, 9, 11, 12, 14, 16 to 18 and 21 to 23, and Comparative Examples 7 to 14, the same type of alloy was used for the substrate in each of the materials. The salt spray time was set to 240 hours for the aluminum material and 120 hours for the magnesium material, and the corrosion resistance of the ceramic film was relatively evaluated in four levels of excellent, good, fair and poor in order of decreasing quality based on the area of rust after the passage of a predetermined period of time. The results are shown in Tables 4 and 5.

14. Evaluation of Corrosion Resistance of Ceramic Film as Base for Coating

The corrosion resistance of the ceramic film as the base for coating was evaluated using the evaluation plate having undergone epoxy type cationic electrodeposition coating. The substrate used was made of ADC12 material as the aluminum material or AZ91D material as the magnesium material. In Examples 8, 9, 11, 12, 14, 16 to 18 and 21 to 23, and Comparative Examples 7 to 13, the same type of alloy was used for the substrate in each of the materials. The cationic electrodeposition coating was performed by applying Elecron 9400 (Kansai Paint Co., Ltd.) at 200 V for 15 minutes to a film thickness of 15 μm and baking at 175° C. for 20 minutes. Then, artificial cross cut scratches reaching the substrate metal were formed on the evaluation surface side with a sharp cutter and the salt spray test (JIS Z 2371) was conducted. The salt spray time was set to 4,000 hours for the aluminum material and 2,500 hours for the magnesium material, and the corrosion resistance of the ceramic film was relatively evaluated in four levels of excellent, good, fair and poor in order of decreasing quality based on the area of rust of the surface evaluated after the passage of a predetermined period of time. The results are shown in Tables 4 and 5.

TABLE 1

| | Electrolysis solutions | | | | | | | | |
|---|---|---|---|---|---|---|---|---|---|
| | Treatment solution ingredient | | | | | | | | |
| | Zirconium | Complexing agent | | Carbonate ion | | Phosphoric acid supply source | | Other ingredients added | |
| | Zirconium content (=X)mol/L | Content in compound solution (=Y)mol/L | Y/X | Carbonate ion content (=Z)mol/L | Z/X | Type | Phosphorus content mol/L | Poorly soluble particle content g/L | Metallic ion content mol/L |
| EX 1 | 0.009 | 0.0015 | 0.17 | 0.0280 | 3.1 | — | 0 | — | — |
| EX 2 | 0.400 | 0.0080 | 0.02 | 1.1000 | 2.8 | Pyrophosphoric acid | 0.008 | — | — |
| EX 3 | 0.0063 | 0.1500 | 23.81 | 0.1126 | 17.9 | Pyrophosphoric acid | 0.1 | — | — |
| EX 5 | 0.020 | 0.0500 | 2.50 | 0.0600 | 3.0 | Pyrophosphoric acid | 0.15 | — | — |
| EX 6 | 0.010 | 0.0010 | 0.10 | 0.1200 | 12.0 | Ortho-phosphoric acid | 0.4 | — | — |
| EX 8 | 0.015 | 0.0030 | 0.20 | 0.1300 | 8.7 | Ortho-phosphoric acid | 0.07 | Alumina sol 2 g/L | — |
| EX 9 | 0.015 | 0.0030 | 0.20 | 0.1300 | 8.7 | Ortho-phosphoric acid | 0.07 | chromium carbide powder | — |
| EX 10 | 0.010 | 0.0050 | 0.50 | 0.0500 | 5.0 | Pyrophosphoric acid | 0.05 | — | Titanium lactate 0.01 mol/L |
| EX 11 | 0.020 | 0.0050 | 0.25 | 0.1400 | 7.0 | Ortho-phosphoric acid | 0.06 | — | — |
| EX 12 | 0.020 | 0.0050 | 0.25 | 0.1400 | 7.0 | Ortho-phosphoric acid | 0.06 | — | — |
| EX 13 | 0.020 | 0.0050 | 0.25 | 0.1400 | 7.0 | — | 0 | — | — |
| EX 14 | 0.050 | 0.0006 | 0.01 | 0.2000 | 4.0 | Pyrophosphoric acid | 0.1 | Silica sol 0.8 g/L | — |
| EX 15 | 0.060 | 0.0100 | 0.17 | 0.1800 | 3.0 | — | 0 | Silica sol 1.5 g/L | — |
| EX 16 | 0.050 | 0.0030 | 0.06 | 0.3000 | 6.0 | Pyrophosphoric acid | 0.11 | — | — |
| EX 21 | 0.0500 | 0.0250 | 0.50 | 0.2500 | 5.0 | Ortho-phosphoric acid | 0.06 | — | — |
| EX 22 | 0.009 | 0.0110 | 1.22 | 0.0380 | 4.2 | Ortho-phosphoric acid | 0.02 | — | — |
| EX 23 | 0.0007 | 0.0200 | 28.57 | 0.0034 | 4.9 | Ortho-phosphoric acid | 0.03 | — | Sodium aluminate 0.061 mol/L |
| EX 24 | 0.015 | 0.0500 | 3.33 | 0.1800 | 12.0 | Pyrophosphoric acid | 0.15 | — | — |
| EX 25 | 0.010 | 0.0500 | 5.00 | 0.0700 | 7.0 | Ortho-phosphoric acid | 0.8 | — | — |
| EX 27 | 0.003 | 0.0200 | 6.67 | 0.0160 | 5.3 | Ortho-phosphoric acid | 0.04 | Zirconia sol 1.5 g/L | — |
| EX 30 | 0.005 | 0.1000 | 20.00 | 0.0700 | 14.0 | Ortho-phosphoric acid | 0.03 | — | — |
| EX 31 | 0.041 | 0.0200 | 0.49 | 0.1020 | 2.5 | — | 0 | — | — |

TABLE 1-continued

| Electrolysis solutions | | | | | | | | | |
|---|---|---|---|---|---|---|---|---|---|
| EX 32 | 0.100 | 0.0400 | 0.40 | 0.4000 | 4.0 | — | 0 | — | — |
| CE 1 | 0.020 | 0.0000 | 0.00 | 0.1400 | 7.0 | Ortho-phosphoric acid | 0.06 | — | — |
| CE 2 | 0.020 | 0.0001 | 0.01 | 0.0400 | 2.0 | Ortho-phosphoric acid | 0.06 | — | — |
| CE 3 | 0.002 | 0.0005 | 0.25 | 0.0140 | 7.0 | Ortho-phosphoric acid | 0.006 | — | — |
| CE 5 | 0.020 | 0.0050 | 0.25 | 0.1400 | 7.0 | Ortho-phosphoric acid | 0.06 | — | — |
| CE 6 | 0.020 | 0.0050 | 0.25 | 0.1400 | 7.0 | Ortho-phosphoric acid | 0.06 | — | — |
| CE 7 | Described in Comparative Example 7 | | | | | | | | |
| CE 8 | 0.000 | 0.0050 | — | 0.1400 | — | Ortho-phosphoric acid | 0.06 | — | — |
| CE 9 | Described in Comparative Example 9 | | | | | | | | |
| CE 10 | Described in Comparative Example 10 | | | | | | | | |
| CE 11 | Described in Comparative Example 11 | | | | | | | | |
| CE 12 | Described in Comparative Example 12 | | | | | | | | |
| CE 13 | Described in Comparative Example 13 | | | | | | | | |
| CE 14 | Described in Comparative Example 14 | | | | | | | | |

| | Treatment solution ingredient | | | | | |
|---|---|---|---|---|---|---|
| | Solution state | | | | Stability of electrolysis solution | |
| | pH adjustment (for suitable adjustment) | pH | EC | Temperature | Electrolysis stability | Stability with time |
| EX 1 | NaOH | 11.0 | 1.7 | 20 | Good | Good |
| EX 2 | Ammonia | 10.0 | 7.1 | 40 | Good | Good |
| EX 3 | KOH | 9.0 | 1.8 | 4 | Good | Good |
| EX 5 | KOH | 7.6 | 1.4 | 20 | Good | Good |
| EX 6 | KOH | 10.0 | 3.2 | 20 | Good | Good |
| EX 8 | KOH | 8.0 | 1.5 | 20 | Good | Good |
| EX 9 | KOH | 8.0 | 1.5 | 20 | Good | Good |
| EX 10 | Monoethanolamine | 10.0 | 1.6 | 8 | Good | Good |
| EX 11 | NaOH | 11.0 | 1.3 | 5 | Good | Good |
| EX 12 | NaOH | 11.0 | 1.3 | 5 | Good | Good |
| EX 13 | NaOH | 11.0 | 1.3 | 5 | Good | Good |
| EX 14 | KOH | 9.5 | 1.8 | 20 | Good | Good |
| EX 15 | KOH | 10.5 | 1.8 | 20 | Good | Good |
| EX 16 | KOH | 9.7 | 3.0 | 20 | Good | Good |
| EX 21 | KOH | 13.2 | 3.2 | 10 | Good | Good |
| EX 22 | KOH | 12.8 | 2.5 | 16 | Good | Good |
| EX 23 | KOH | 13.0 | 2.8 | 21 | Good | Good |
| EX 24 | NaOH | 12.6 | 1.8 | 4 | Good | Good |
| EX 25 | LiOH | 12.9 | 3.5 | 5 | Good | Good |
| EX 27 | KOH | 13.3 | 3.1 | 16 | Good | Good |
| EX 30 | KOH | 13.4 | 4.1 | 19 | Good | Good |
| EX 31 | KOH | 12.8 | 2.2 | 20 | Good | Good |
| EX 32 | NaOH | 7.8 | 3.1 | 20 | Good | Good |
| CE 1 | NaOH | 11.0 | 1.2 | 5 | Fair | Poor |
| CE 2 | NaOH | 11.0 | 1 | 10 | Good | Fair |
| CE 3 | NaOH | 7.3 | 0.18 | 5 | Good | Good |
| CE 5 | NaOH | 11.0 | 1.3 | 5 | Good | Good |
| CE 6 | NaOH | 11.0 | 1.3 | 5 | Good | Good |
| CE 7 | Described in Comparative Example 7 | | | | — | Poor |
| CE 8 | NaOH | 11.0 | 1.3 | 20 | Good | Fair |
| CE 9 | Described in Comparative Example 9 | | | | — | Poor |
| CE 10 | Described in Comparative Example 10 | | | | Fair | Fair |
| CE 11 | Described in Comparative Example 11 | | | | Good | Fair |
| CE 12 | Described in Comparative Example 12 | | | | — | Fair |
| CE 13 | Described in Comparative Example 13 | | | | — | Fair |
| CE 14 | Described in Comparative Example 14 | | | | — | — |

TABLE 2-1

Electrolysis conditions in Examples

| | Substrate | | Treatment | | | | | | | | |
|---|---|---|---|---|---|---|---|---|---|---|---|
| | | | | First treatment condition | | | | | | | |
| | Light metal type | Alloy type | Total treatment time (min) | Time (min) | Frequency Hz | Positive Control process | Positive Voltage V | Positive Current A/dm$^2$ | Positive Duty ratio (T1) | Negative Control process I or V | Negative Voltage V |
| EX 1 | Al | JIS1050 | 20 | 20 | 10000 | V | 550 | 0.5-40 | 0.15 | V | 150 |
| EX 2 | Al | JIS4043 | 10 | 10 | 5000 | I | 150-650 | 2 | 0.10 | V | 150 |
| EX 3 | Al | ADC6 | 50 | 20 | 60 | V | 550 | 0.5-40 | 0.10 | V | 100 |
| EX 4 | Al | JIS2011 | 70 | 30 | 60 | I | 150-650 | 3 | 0.15 | V | 100 |
| EX 5 | Al | ADC5 | 20 | 10 | 60 | V | 380 | 0.5-40 | 0.12 | — | — |
| EX 6 | Al | ADC10 | 20 | 20 | 100 | I | 150-650 | 3 | 0.10 | V | 100 |
| EX 7 | Al | JIS5052 | 20 | 2 | 14000 | I | 150-650 | 3.1 | 0.10 | I | 10-350 |
| EX 8 | Al | ADC12 | 10 | 10 | 180 | V | 550 | 0.5-40 | 0.08 | V | 90 |
| EX 9 | Al | ADC12 | 10 | 10 | 180 | V | 550 | 0.5-40 | 0.08 | V | 90 |
| EX 10 | Al | JIS7075 | 10 | 10 | 60 | V | 400 | 0.5-40 | 0.10 | V | 180 |
| EX 11 | Al | ADC12 | 20 | 20 | 60 | V | 550 | 0.5-40 | 0.15 | V | 80 |
| EX 12 | Al | ADC12 | 20 | 20 | 60 | V | 550 | 0.5-40 | 0.15 | V | — |
| EX 13 | Al | JIS1050 | 10 | 10 | 60 | V | 550 | 0.5-40 | 0.15 | — | — |
| EX 14 | Al | ADC12 | 5 | 5 | 100 | V | 500 | 0.5-40 | 0.05 | V | 100 |
| EX 15 | Al | AC8A | 4 | 4 | 60 | V | 525 | 0.5-40 | 0.06 | V | 150 |
| EX 16 | Al | ADC12 | 8 | 8 | 70 | V | 320 | 0.5-40 | 0.12 | V | 120 |
| EX 17 | Al | ADC12 | 20 | 2 | 60 | V | 550 | 0.5-40 | 0.15 | V | 80 |
| EX 18 | Al | ADC12 | 10 | 5 | 250 | V | 500 | 0.5-40 | 0.10 | V | 100 |
| EX 21 | Mg | AZ91D | 10 | 10 | 1200 | V | 450 | 0.5-40 | 0.10 | V | 100 |
| EX 22 | Mg | AZ91D | 3 | 3 | 60 | V | 500 | 0.5-40 | 0.12 | V | 80 |
| EX 23 | Mg | AZ91D | 3 | 3 | 60 | V | 500 | 0.5-40 | 0.12 | V | 80 |
| EX 24 | Mg | AM60B | 8 | 3 | 200 | V | 450 | 0.5-40 | 0.15 | — | — |
| EX 25 | Mg | AZ31 | 20 | 20 | 100 | I | 150-650 | 3 | 0.08 | V | 100 |
| EX 26 | Mg | ZK61A | 4 | 2 | 60 | V | 500 | 0.5-40 | 0.12 | V | 80 |
| EX 27 | Mg | EZ33 | 10 | 10 | 500 | V | 550 | 0.5-40 | 0.12 | V | 100 |
| EX 30 | Ti | Pure Ti | 20 | 20 | 100 | V | 350 | 0.5-40 | 0.12 | V | 200 |
| EX 31 | Ti | JIS60 | 6 | 6 | 60 | V | 450 | 0.5-40 | 0.12 | V | 110 |
| EX 32 | Ti | Ti—Al | 12 | 12 | 200 | V | 500 | 0.5-40 | 0.08 | V | 110 |

| | Treatment | | | | | | |
|---|---|---|---|---|---|---|---|
| | First treatment condition | | | | | | |
| | Negative | | Pulse off period | | | Waveform | |
| | Current A/dm$^2$ | Duty ratio (T2) | Duty ratio (T3) | T2/T1 | T3/(T1 + T2) | Positive | Negative |
| EX 1 | — | 0.05 | 0.80 | 0.3 | 4.0 | Sinusoidal | Sinusoidal |
| EX 2 | — | 0.20 | 0.70 | 2.0 | 2.3 | Square | Square |
| EX 3 | — | 0.10 | 0.80 | 1.0 | 4.0 | Square | Square |
| EX 4 | — | 0.10 | 0.75 | 0.7 | 3.0 | Square | Square |
| EX 5 | — | — | 0.88 | 0.0 | 7.3 | Sinusoidal | Sinusoidal |
| EX 6 | — | 0.01 | 0.89 | 0.1 | 8.1 | Sinusoidal | Triangular |
| EX 7 | 5 | 0.10 | 0.80 | 1.0 | 4.0 | Sinusoidal | Sinusoidal |
| EX 8 | — | 0.10 | 0.82 | 1.3 | 4.6 | Square | Square |
| EX 9 | — | 0.10 | 0.82 | 1.3 | 4.6 | Square | Square |
| EX 10 | — | 0.05 | 0.85 | 0.5 | 5.7 | Sinusoidal | Sinusoidal |
| EX 11 | — | 0.10 | 0.75 | 0.7 | 3.0 | Sinusoidal | Sinusoidal |
| EX 12 | — | 0.00 | 0.85 | 0.0 | 5.7 | Sinusoidal | Sinusoidal |
| EX 13 | — | — | 0.85 | 0.0 | 5.7 | Sinusoidal | — |
| EX 14 | — | 0.02 | 0.93 | 0.4 | 13.3 | Square | Sinusoidal |
| EX 15 | — | 0.06 | 0.88 | 1.0 | 7.3 | Square | Square |
| EX 16 | — | 0.10 | 0.78 | 0.8 | 3.5 | Square | Square |
| EX 17 | — | 0.10 | 0.75 | 0.7 | 3.0 | Sinusoidal | Sinusoidal |
| EX 18 | — | 0.10 | 0.80 | 1.0 | 4.0 | Square | Square |
| EX 21 | — | 0.08 | 0.82 | 0.8 | 4.6 | Square | Square |
| EX 22 | — | 0.12 | 0.76 | 1.0 | 3.2 | Square | Square |
| EX 23 | — | 0.12 | 0.76 | 1.0 | 3.2 | Sinusoidal | Sinusoidal |
| EX 24 | — | 0.00 | 0.85 | 0.0 | 5.7 | Sinusoidal | — |
| EX 25 | — | 0.01 | 0.91 | 0.1 | 10.1 | Sinusoidal | Triangular |
| EX 26 | — | 0.12 | 0.76 | 1.0 | 3.2 | Sinusoidal | Sinusoidal |
| EX 27 | — | 0.12 | 0.76 | 1.0 | 3.2 | Square | Square |
| EX 30 | — | 0.02 | 0.86 | 0.2 | 6.1 | Square | Square |
| EX 31 | — | 0.12 | 0.76 | 1.0 | 3.2 | Sinusoidal | Sinusoidal |
| EX 32 | — | 0.08 | 0.84 | 1.0 | 5.3 | Sinusoidal | Sinusoidal |

TABLE 2-2

Electrolysis conditions in Examples

| | Substrate | | Treatment | | | | | | | | | |
|---|---|---|---|---|---|---|---|---|---|---|---|---|
| | | | | | Second treatment condition | | | | | | | |
| | | | | First | | | Positive | | | | Negative | |
| | Light metal type | Alloy type | Total treatment time (min) | treatment condition Time (min) | Time (min) | Fre-quency Hz | Control process I or V | Voltage V | Current A/dm$^2$ | Duty ratio (T1) | Control process I or V | Voltage V |
| EX 1 | Al | JIS1050 | 20 | 20 | — | — | — | — | — | — | — | — |
| EX 2 | Al | JIS4043 | 10 | 10 | — | — | — | — | — | — | — | — |
| EX 3 | Al | ADC6 | 50 | 20 | 30 | 60 | I | 150-650 | 1.9 | 0.10 | V | 100 |
| EX 4 | Al | JIS2011 | 70 | 30 | 40 | 60 | I | 150-650 | 1.9 | 0.10 | V | 100 |
| EX 5 | Al | ADC5 | 20 | 10 | 10 | 100 | V | 550 | 0.5-40 | 0.12 | V | 120 |
| EX 6 | Al | ADC10 | 20 | 20 | — | — | — | — | — | — | — | — |
| EX 7 | Al | JIS5052 | 20 | 2 | 18 | 60 | I | 150-650 | 0.9 | 0.10 | I | 10-350 |
| EX 8 | Al | ADC12 | 10 | 10 | — | — | — | — | — | — | — | — |
| EX 9 | Al | ADC12 | 10 | 10 | — | — | — | — | — | — | — | — |
| EX 10 | Al | JIS7075 | 10 | 10 | — | — | — | — | — | — | — | — |
| EX 11 | Al | ADC12 | 20 | 20 | — | — | — | — | — | — | — | — |
| EX 12 | Al | ADC12 | 20 | 20 | — | — | — | — | — | — | — | — |
| EX 13 | Al | JIS1050 | 10 | 10 | — | — | — | — | — | — | — | — |
| EX 14 | Al | ADC12 | 5 | 5 | — | — | — | — | — | — | — | — |
| EX 15 | Al | AC8A | 4 | 4 | — | — | — | — | — | — | — | — |
| EX 16 | Al | ADC12 | 8 | 8 | — | — | — | — | — | — | — | — |
| EX 17 | Al | ADC12 | 20 | 2 | 18 | 60 | V | 550 | 0.5-40 | 0.15 | V | 80 |
| EX 18 | Al | ADC12 | 10 | 5 | 5 | 250 | I | 150-650 | 2.3 | 0.10 | V | 100 |
| EX 21 | Mg | AZ91D | 10 | 10 | — | — | — | — | — | — | — | — |
| EX 22 | Mg | AZ91D | 3 | 3 | — | — | — | — | — | — | — | — |
| EX 23 | Mg | AZ91D | 3 | 3 | — | — | — | — | — | — | — | — |
| EX 24 | Mg | AM60B | 8 | 3 | 5 | 200 | V | 550 | 0.5-40 | 0.12 | V | 130 |
| EX 25 | Mg | AZ31 | 20 | 20 | — | — | — | — | — | — | — | — |
| EX 26 | Mg | ZK61A | 4 | 2 | 2 | 60 | V | 500 | 0.5-40 | 0.12 | V | 80 |
| EX 27 | Mg | EZ33 | 10 | 10 | — | — | — | — | — | — | — | — |
| EX 30 | Ti | Pure Ti | 20 | 20 | — | — | — | — | — | — | — | — |
| EX 31 | Ti | JIS60 | 6 | 6 | — | — | — | — | — | — | — | — |
| EX 32 | Ti | Ti—Al | 12 | 12 | — | — | — | — | — | — | — | — |

| | Treatment Second treatment condition | | | | | | | |
|---|---|---|---|---|---|---|---|---|
| | Negative | | Pulse off period | | | | | Presence |
| | Current A/dm$^2$ | Duty ratio (T2) | Duty ratio (T3) | T2/T1 | T3/ (T1 + T2) | Waveform Positive | Waveform Negative | of light emission |
| EX 1 | — | — | — | — | — | — | — | Yes |
| EX 2 | — | — | — | — | — | — | — | Yes |
| EX 3 | — | 0.10 | 0.8 | 1.0 | 4.0 | Square | Square | Yes |
| EX 4 | — | 0.10 | 0.8 | 1.0 | 4.0 | Square | Square | Yes |
| EX 5 | — | 0.12 | 0.8 | 1.0 | 3.2 | Sinusoidal | Sinusoidal | Yes |
| EX 6 | — | — | — | — | — | — | — | Yes |
| EX 7 | 2.5 | 0.10 | 0.8 | 1.0 | 4.0 | Square | Square | Yes |
| EX 8 | — | — | — | — | — | — | — | Yes |
| EX 9 | — | — | — | — | — | — | — | Yes |
| EX 10 | — | — | — | — | — | — | — | Yes |
| EX 11 | — | — | — | — | — | — | — | Yes |
| EX 12 | — | — | — | — | — | — | — | Yes |
| EX 13 | — | — | — | — | — | — | — | Yes |
| EX 14 | — | — | — | — | — | — | — | Yes |
| EX 15 | — | — | — | — | — | — | — | Yes |
| EX 16 | — | — | — | — | — | — | — | Yes |
| EX 17 | — | 0.10 | 0.75 | 0.7 | 3.0 | Sinusoidal | Sinusoidal | Yes |
| EX 18 | — | 0.10 | 0.80 | 1.0 | 4.0 | Square | Square | Yes |
| EX 21 | — | — | — | — | — | — | — | Yes |
| EX 22 | — | — | — | — | — | — | — | Yes |
| EX 23 | — | — | — | — | — | — | — | Yes |
| EX 24 | — | 0.12 | 0.8 | 1.0 | 3.2 | Sinusoidal | Sinusoidal | Yes |
| EX 25 | — | — | — | — | — | — | — | Yes |
| EX 26 | — | 0.12 | 0.76 | 1.0 | 3.2 | Square | Square | Yes |
| EX 27 | — | — | — | | — | — | — | Yes |
| EX 30 | — | — | — | — | — | — | — | Yes |
| EX 31 | — | — | — | — | — | — | — | Yes |
| EX 32 | — | — | — | — | — | — | — | Yes |

TABLE 3

Electrolysis conditions in Comparative Examples

| | Substrate | | Treatment | | | | | | | |
|---|---|---|---|---|---|---|---|---|---|---|
| | | | | | Positive | | | | Negative | |
| | Light metal type | Alloy type | Treatment time (min) | Frequency Hz | Control process I or V | Voltage V | Current A/dm$^2$ | Duty ratio (T1) | Control process I or V | Voltage V |
| CE 1 | Al | ADC12 | 20 | 60 | V | 550 | 0.5-40 | 0.15 | V | 80 |
| CE 2 | Al | ADC12 | 20 | 60 | V | 550 | 0.5-40 | 0.15 | V | 80 |
| CE 3 | Al | ADC12 | 20 | 60 | V | 550 | <0.5 | 0.15 | V | 80 |
| CE 5 | Al | ADC12 | 20 | 60 | V | 550 | 0.5-40 | 0.04 | V | 80 |
| CE 6 | Al | ADC12 | 20 | 60 | V | 140 | <0.5 | 0.15 | V | 80 |
| CE 8 | Al | ADC12 | 20 | 60 | V | 550 | 0.5-40 | 0.15 | V | 80 |
| CE 10 | Al | ADC12 | 20 | 60 | V | 550 | 0.5-40 | 0.15 | V | 80 |
| CE 11 | Mg | AZ91D | 3 | 60 | V | 500 | 0.5-40 | 0.12 | V | 80 |

| | Treatment | | | | | | | |
|---|---|---|---|---|---|---|---|---|
| | Negative | | Pulse off period | | | | | |
| | Current A/dm$^2$ | Duty ratio (T2) | Duty ratio (T3) | T2/T1 | T3/(T1 + T2) | Waveform Positive | Waveform Negative | Presence of light emission |
| CE 1 | — | 0.10 | 0.75 | 0.7 | 3.0 | Sinusoidal | Sinusoidal | Yes |
| CE 2 | — | 0.10 | 0.75 | 0.7 | 3.0 | Sinusoidal | Sinusoidal | Yes |
| CE 3 | — | 0.10 | 0.75 | 0.7 | 3.0 | Sinusoidal | Sinusoidal | No |
| CE 5 | — | 0.50 | 0.46 | 12.5 | 0.9 | Sinusoidal | Sinusoidal | No |
| CE 6 | — | 0.10 | 0.75 | 0.7 | 3.0 | Sinusoidal | Sinusoidal | No |
| CE 8 | — | 0.10 | 0.75 | 0.7 | 3.0 | Sinusoidal | Sinusoidal | Yes |
| CE 10 | — | 0.10 | 0.75 | 0.7 | 3.0 | Sinusoidal | Sinusoidal | Yes |
| CE 11 | — | 0.12 | 0.76 | 1.0 | 3.2 | Square | Square | Yes |

TABLE 4

Evaluation results of ceramic films in Examples

| | Substrate | | | | Film properties | | | | |
|---|---|---|---|---|---|---|---|---|---|
| | Light metal type | Alloy type | Presence of light emission | Post-treatment | Film thickness μm | Zr wt % | Roughness (Ra) μm | Hardness HV | Adhesion |
| EX 1 | Al | JIS1050 | Yes | — | 15 | 21 | 1.1 | 1150 | Excellent |
| EX 2 | Al | JIS4043 | Yes | — | 13 | 52 | 1.8 | 840 | Excellent |
| EX 3 | Al | ADC6 | Yes | — | 65 | 8 | 5.1 | 1380 | Good |
| EX 4 | Al | JIS2011 | Yes | — | 72 | 8 | 6.3 | 1365 | Good |
| EX 5 | Al | ADC5 | Yes | — | 16 | 48 | 2.4 | 895 | Excellent |
| EX 6 | Al | ADC10 | Yes | — | 25 | 33 | 2.4 | 864 | Good |
| EX 7 | Al | JIS5052 | Yes | — | 21 | 9 | 1.7 | 1310 | Excellent |
| EX 8 | Al | ADC12 | Yes | — | 12 | 26 | 0.95 | 1430 | Excellent |
| EX 9 | Al | ADC12 | Yes | — | 13 | 23 | 0.83 | 1620 | Excellent |
| EX 10 | Al | JIS7075 | Yes | — | 7 | 27 | 0.43 | 730 | Excellent |
| EX 11 | Al | ADC12 | Yes | — | 12 | 25 | 0.58 | 1040 | Excellent |
| EX 12 | Al | ADC12 | Yes | — | 11 | 25 | 0.58 | 1050 | Fair |
| EX 13 | Al | JIS1050 | Yes | — | 17 | 27 | 0.42 | 1032 | Excellent |
| EX 14 | Al | ADC12 | Yes | — | 4.5 | 30 | 0.51 | 710 | Excellent |
| EX 15 | Al | AC8A | Yes | — | 6.1 | 31 | 0.37 | 673 | Excellent |
| EX 16 | Al | ADC12 | Yes | — | 5.3 | 32 | 0.35 | 930 | Excellent |
| EX 17 | Al | ADC12 | Yes | — | 11 | 25 | 0.56 | 1065 | Excellent |
| EX 18 | Al | ADC12 | Yes | — | 9.5 | 38 | 0.48 | 910 | Excellent |
| EX 19 | Al | AOC12 | | Polishing | 10 | 25 | 0.29 | 1040 | Excellent |
| EX 20 | Al | ADC12 | | Lubricant application | — | — | — | — | — |
| EX 21 | Mg | AZ91D | Yes | — | 12 | 24 | 0.61 | 625 | Excellent |
| EX 22 | Mg | AZ91D | Yes | — | 9.6 | 16 | 0.44 | 804 | Excellent |
| EX 23 | Mg | AZ91D | Yes | — | 7.3 | 5 | 0.51 | 1081 | Excellent |
| EX 24 | Mg | AM60B | Yes | — | 10 | 18 | 0.58 | 768 | Excellent |
| EX 25 | Mg | AZ31 | Yes | — | 18 | 15 | 0.93 | 870 | Excellent |
| EX 26 | Mg | ZK61A | Yes | — | 12 | 15 | 0.57 | 821 | Excellent |

TABLE 4-continued

| Evaluation results of ceramic films in Examples | | | | | | | | | |
|---|---|---|---|---|---|---|---|---|---|
| EX 27 | Mg | EZ33 | Yes | — | 15 | 28 | 0.81 | 745 | Excellent |
| EX 28 | Mg | AZ91D | Yes | Polishing | 8.5 | — | 0.27 | — | — |
| EX 29 | Mg | AZ91D | Yes | Lubricant application | — | — | — | — | — |
| EX 30 | Ti | Pure Ti | Yes | — | 10 | 6 | 0.81 | 520 | Excellent |
| EX 31 | Ti | JIS60 | Yes | — | 5.0 | 37 | 0.68 | 760 | Excellent |
| EX 32 | Ti | Ti—Al | Yes | — | 19.4 | 53 | 0.98 | 810 | Good |

| | Film properties | | | | | |
|---|---|---|---|---|---|---|
| | | Sliding evaluation | | | Corrosion resistance | |
| | Appearance | Coefficient of friction | Wear of film Depth μm | Wear of counterpart member Area | Corrosion resistance of film | Corrosion resistance as base for coating |
| EX 1 | Good Whitish gray | — | — | — | — | — |
| EX 2 | Good Whitish gray | — | — | — | — | — |
| EX 3 | Good Gray | — | — | — | — | — |
| EX 4 | Good Gray | — | — | — | — | — |
| EX 5 | Good Gray | — | — | — | — | — |
| EX 6 | Good Gray | — | — | — | — | — |
| EX 7 | Good Gray | — | — | — | — | — |
| EX 8 | Good Gray | 0.25-0.30 | 0 | Good | Excellent | Excellent |
| EX 9 | Good Gray | 0.25-0.30 | 0 | Good | Excellent | Excellent |
| EX 10 | Good Brown | — | — | — | — | — |
| EX 11 | Good Gray | 0.15-0.20 | 0.1 | Excellent | Excellent | Excellent |
| EX 12 | Good Gray | 0.15-0.20 | 0.1 | Excellent | Good | Good |
| EX 13 | Good White | — | — | — | — | — |
| EX 14 | Good Gray | 0.15-0.20 | 0.2 | Excellent | Good | Good |
| EX 15 | Good Gray | — | — | — | — | — |
| EX 16 | Good Gray | 0.10-0.15 | 0.1 | Excellent | Excellent | Excellent |
| EX 17 | Good Gray | 0.15-0.20 | 0.1 | Excellent | Excellent | Excellent |
| EX 18 | Good Gray | 0.15-0.20 | 0.2 | Excellent | Excellent | Excellent |
| EX 19 | Good Gray | 0.10-0.15 | 0 | Excellent | — | — |
| EX 20 | — | 0.10-0.15 | 0 | Excellent | — | — |
| EX 21 | Good Gray | 0.15-0.20 | 0.4 | Excellent | Excellent | Excellent |
| EX 22 | Good Gray | 0.15-0.20 | 0.2 | Excellent | Excellent | Excellent |
| EX 23 | Good Gray | 0.15-0.20 | 0 | Excellent | Excellent | Good |
| EX 24 | Good Gray | — | — | — | — | — |
| EX 25 | Good Gray | — | — | — | — | — |
| EX 26 | Good Gray | — | — | — | — | — |
| EX 27 | Good Gray | — | — | — | — | — |
| EX 28 | Good Gray | 0.10-0.15 | 0 | Excellent | — | — |
| EX 29 | — | 0.10-0.15 | 0 | Excellent | — | — |

TABLE 4-continued

| Evaluation results of ceramic films in Examples | | | | | | |
|---|---|---|---|---|---|---|
| EX 30 | Good<br>Whitish gray | 0.15-0.20 | 0.4 | Excellent | — | — |
| EX 31 | Good<br>Gray brown | 0.15-0.20 | 0.3 | Excellent | — | — |
| EX 32 | Good<br>Whitish gray | 0.15-0.20 | 0.2 | Excellent | — | — |

TABLE 5

Evaluation results of ceramic films in Comparative Examples

| | Substrate | | | Film properties | | | | |
|---|---|---|---|---|---|---|---|---|
| | Light metal type | Alloy type | Presence of light emission | Film thickness μm | Zr wt % | Roughness (Ra) μm | Hardness HV | Adhesion |
| CE 1 | Al | ADC12 | Yes | Difficult | — | — | — | — |
| CE 2 | Al | ADC12 | Yes | Difficult | — | — | — | — |
| CE 3 | Al | ADC12 | No | 0 | — | — | — | — |
| CE 5 | Al | ADC12 | No | 0 | — | — | — | — |
| CE 6 | Al | ADC12 | No | 0 | — | — | — | — |
| CE 7 | Al | ADC12 | — | up to 0.1 nm | 0 | 0.17 | —<br>Unmeasurable | Excellent |
| CE 8 | Al | ADC12 | Yes | 4 | 0 | 0.62 | 1380 | Poor |
| CE 9 | Al | ADC12 | No | 20 | 0 | 1.19 | 365 | Good |
| CE 10 | Al | ADC12 | Yes | 10 | 0 | 1.02 | 1490 | Poor |
| CE 11 | Mg | AZ91D | Yes | 15 | 0 | 1.28 | 1280 | Poor |
| CE 12 | Mg | AZ91D | No | 15 | 0 | 0.98 | 357 | Fair |
| CE 13 | Mg | AZ91D | No | 20 | 0 | 1.06 | 382 | Fair |
| CE 14 | Ti | JIS60 | No | 40 | 0 | 1.24 | 821 | Good |

| | Film properties | | | | | |
|---|---|---|---|---|---|---|
| | | Sliding evaluation | | | Corrosion resistance | |
| | Appearance | Coefficient of friction | Wear of film Depth μm | Wear of counterpart member Area | Corrosion resistance of film | Corrosion resistance as base for coating |
| CE 1 | Poor | — | — | — | — | — |
| CE 2 | Good | — | — | — | — | — |
| CE 3 | — | — | — | — | — | — |
| CE 5 | Poor | — | — | — | — | — |
| CE 6 | — | — | — | — | — | — |
| CE 7 | Pale yellow | 0.50-0.60 | 4.5<br>stopped | Poor | Poor | Poor |
| CE 8 | Gray | 0.35-0.40 | 3.4<br>stopped | Poor | Fair | Fair |
| CE 9 | Light gray | 0.35-0.40 | 2.2 | Fair | Poor | Poor |
| CE 10 | Gray | 0.40-0.50 | 3.5<br>stopped | Fair | Fair | Fair |
| CE 11 | Gray | 0.40-0.50 | 2.4<br>stopped | Fair | Fair | Fair |
| CE 12 | Light brown | 0.40-0.50 | 1.5 | Good | Fair | Fair |
| CE 13 | Green | 0.40-0.50 | 1.7 | Fair | Fair | Fair |
| CE 14 | White | 0.35-0.40 | 1.8 | Fair | — | — |

1. Solution Stability

As is seen from Table 1, in all of the electrolysis solutions in Examples 1 to 3, 5, 6, 8 to 15, 20 to 24, 26 and 29 to 32 which fall within the scope of the invention, the stability during the electrolytic treatment and the stability with time of the electrolysis solutions left to stand were both good, and there was no change in the solution appearance compared to the beginning, nor did precipitation occur. In Comparative Example 1 which is outside the scope of the invention because of the non-use of the complexing agent unlike Example 11, a small amount of a whitish substance was suspended in the solution during the electrolytic treatment and a large amount of white precipitate was also formed with time. In Comparative Example 2 in which the carbonate ion content was smaller than that in Example 11, the stability during the electrolytic treatment was good but a small amount of white precipitate was formed with time. In Comparative Example 3, the electrolysis solution had good stability during the electrolytic treatment and also with time when left to stand, but was not capable of forming a good ceramic film during the electrolytic treatment.

2. State During Electrolytic Treatment and Appearance of Resulting Ceramic Film

In Examples 1 to 3, 5, 6, 8 to 16, 21 to 25, 27 and 30 to 32 which fall within the scope of the invention, light emission from the glow discharge and/or arc discharge occurred during the electrolytic treatment to form a ceramic film with a good appearance.

In Comparative Example 1 in which light emission from the discharge occurred during the treatment and a ceramic film was formed but a substance was suspended in the solution for lack of the solution stability, tangible bosses (projections) were slightly formed at the surface of the ceramic film. In Comparative Example 3 in which the electrolysis solution had an extremely low electrical conductivity, light emission from the discharge did not occur during the electrolytic treatment and no ceramic film was formed.

As for the electrolysis conditions, in Comparative Example 5 in which the ratio T2/T1 exceeded the range defined in the invention and in Comparative Example 6 in which the average current density on the positive side was below the range defined in the invention, light emission from the discharge did not occur and no film was formed at all.

In Comparative Examples 8, 10 and 11 in which the PEO treatment using the electrolysis solutions containing no zirconium compound was performed, light emission from the discharge occurred and a ceramic film with a good appearance was formed. In Comparative Examples 9, 12 and 13 in which anodization which is already very often employed in the world and involves no light emission from the discharge was performed, a ceramic film with a good appearance was formed.

3. Evaluation Results of Adhesion

In all of Examples, the adhesion was "good" or "excellent". The electrolysis solution used in Example 32 was the same as that used in Example 11 but the electrolysis conditions were different in that no application was made to the negative side. The electrolysis solution containing a phosphate compound had a tendency to have a slightly reduced adhesion when no application was made to the negative side. In Comparative Examples 8, 10 and 11 in which the PEO treatment using the electrolysis solutions containing no zirconium compound was performed, the films considerably peeled off, and the adhesion, flexibility and impact resistance were poor. In the case of anodizing treatment involving no light emission from the discharge, the adhesion was good in Comparative Example 9 but in Comparative Examples 12 and 13, the film partially peeled off to some extent. In Comparative Example 7 in which a chemical conversion film with a thickness of up to 0.1 μm was formed by chemical conversion treatment and Comparative Example 14 in which a ceramic film was formed by high temperature oxidation, the adhesion was good.

4. Evaluation Results of Sliding Properties

In all of the ceramic films in Examples 8, 9, 11, 14, 16 to 23 and 28 to 32, the coefficient of friction was 0.30 or less. The ceramic films had a depth of wear as small as 0.4 μm or less and exhibited good wear resistance. In addition, the likelihood of attacking the counterpart member was also low because of the small area of wear of the counterpart member. There was a tendency that the smaller the surface roughness is, the lower the likelihood of attacking the counterpart member is, the lower the coefficient of friction is. Examples 19 and 28 in which the machining was performed as a post-treatment for smoothening showed a lower coefficient of friction than Examples 11 and 22 in which the machining was not performed. Examples 20 and 29 in which the lubricating film was applied in the post-treatment showed a lower coefficient of friction than Examples 11 and 22 in which the post-treatment was not performed.

In Comparative Examples 8, 10 and 11 in which the PEO treatment using the electrolysis solutions containing no zirconium compound was performed, the sliding area of the film was completely worn out or peeled off from the substrate metal during the test to adhere to the sliding counterpart member, and therefore the test was interrupted before the planned number of reciprocating sliding cycles of 500 was reached. In Comparative Examples 9, 12 and 13 in which anodizing treatment involving no light emission from the discharge was performed and Comparative Example 14 in which an oxide film was formed by high temperature oxidation, the ceramic films had a depth of wear of more than 1 μm, a coefficient of friction of at least 0.35 and a rather high likelihood of attacking the counterpart member.

5. Evaluation Results of Corrosion Resistance of Ceramic Film Itself

In all of the ceramic films in Examples 8, 9, 11, 12, 14, 16 to 18 and 21 to 23, the corrosion resistance was "good" or "excellent". Particularly in the films rated "excellent", white rust hardly occurred after the end of the test. In Comparative Examples 7 and 9, white rust occurred on the whole surface 72 hours after the start of the salt spray test. In Comparative Examples 8 and 10, white rust occurred on the whole surface 120 hours after the start of the salt spray test. In Comparative Examples 11 to 13, white rust occurred on the whole surface 12 hours after the start of the salt spray test.

6. Evaluation Results of Corrosion Resistance of Ceramic Film as Base for Coating All of the ceramic films in Examples 8, 9, 11, 12, 14, 16 to 18 and 21 to 23 had sufficiently high corrosion resistance (good, excellent) to use as the base for coating. In both of the films rated "good" and "excellent", no rusting and blistering were seen in the planar section of the film except the cross cut scratches. Particularly in the films rated "excellent", occurrence of white rust could not be visually observed even in the cross cut scratches after the end of the test. In Comparative Examples 7 and 9, white rust occurred at the cross cuts 1,000 hours after the start of the salt spray test and rusting and blistering also occurred in countless places on the planar section having no scratches at the end of 4,000 hours. In Comparative Examples 8 and 10, rusting and blistering also occurred in many places on the planar section having no scratches 4,000 hours after the start of the salt spray test. In Comparative Example 11, rusting and blistering also occurred in many places on the planar section having no scratches 500 hours after the start of the salt spray test. In Comparative Examples 12 and 13, rusting and blistering occurred on the whole surface 120 hours after the start of the salt spray test.

What is claimed is:

1. An electrolysis solution for electrolytic ceramic coating used in a method of electrolytic ceramic coating on metal in which at least one metal selected from the group consisting of aluminum, an aluminum alloy, magnesium, a magnesium alloy, titanium and a titanium alloy is used as an anode to anodize a surface of the anode in the electrolysis solution as glow discharge and/or arc discharge is generated to thereby form a ceramic film on the surface of the metal, wherein the electrolysis solution comprises water, a water-soluble zirconium compound, a complexing agent, carbonate ion, and at least one member selected from the group consisting of an alkali metal ion, ammonium ion and an organic alkali, wherein the zirconium compound is included at a concentration (X) in terms of zirconium of 0.0001 to 1 mol/L, wherein the complexing agent is included at a concentration (Y) of 0.0001 to 0.3 mol/L, wherein the carbonate ion is included at a concentration (Z) of 0.0002 to 4 mol/L, wherein a ratio of the concentration (Y) of the complexing agent to the concentration (X) in terms of zirconium (Y/X) is at least 0.01, wherein a ratio of the concentration (Z) of the carbonate ion to the concentration (X) in terms of zirconium (Z/X) is at least 2.5, and wherein the electrolysis solution has an electrical conductivity of 0.2 to 20 S/m.

2. The electrolysis solution for electrolytic ceramic coating according to claim 1, wherein the electrolysis solution further comprises poorly soluble particles of at least one member selected from the group consisting of an oxide, a hydroxide, a nitride and a carbide, and wherein the poorly soluble particles are included at a concentration of 0.01 to 100 g/L.

3. The electrolysis solution for electrolytic ceramic coating according to claim 1, further comprising at least one metallic ion selected from the group consisting of silicon, titanium, aluminum, niobium, yttrium, magnesium, copper, zinc, scandium and cerium at a concentration in terms of elemental metal of 0.0001 to 1 mol/L.

4. The electrolysis solution for electrolytic ceramic coating according to claim 1, wherein the electrical conductivity is 0.5 to 10 S/m.

5. The electrolysis solution for electrolytic ceramic coating according to claim 1, wherein the zirconium compound is a zirconium carbonate compound.

6. The electrolysis solution for electrolytic ceramic coating according to claim 1, wherein the metal used as the anode is aluminum or an aluminum alloy and wherein the electrolysis solution has a pH of 7 to 12.

7. The electrolysis solution for electrolytic ceramic coating according to claim 1, wherein the metal used as the anode is magnesium or a magnesium alloy and wherein the electrolysis solution has a pH of 9 to 14.

8. The electrolysis solution for electrolytic ceramic coating according to claim 1, wherein the metal used as the anode is titanium or a titanium alloy and wherein the electrolysis solution has a pH of 7 to 14.

9. The electrolysis solution for electrolytic ceramic coating according to claim 1, further comprising a water-soluble phosphate compound at a concentration in terms of phosphorus of 0.001 to 1 mol/L.

10. A method of providing an electrolytic ceramic coating on a metal comprising the steps of providing at least one metal selected from the group consisting of aluminum, an aluminum alloy, magnesium, a magnesium alloy, titanium and a titanium alloy as an anode and an application means, at least part of which shows a positive side, to perform an anodizing treatment of a surface of the anode in the electrolysis solution for electrolytic ceramic coating according to claim 1 under glow discharge and/or arc discharge to thereby form a ceramic film on the surface of the metal, wherein an average current density during positive side application is in a range of 0.5 to 40 $A/dm^2$, and wherein the anodizing treatment is performed at a positive side duty ratio (T1) of 0.02 to 0.5, a negative side duty ratio (T2) of 0 to 0.5, a non-application time ratio per unit time (T3) of 0.35 to 0.95, and these ratios simultaneously meet the following formulas:

$$0 \le T2/T1 \le 10$$

$$0.5 \le T3/(T1+T2) \le 20.$$

11. The method of electrolytic ceramic coating according to claim 10, wherein at least part of the anodizing treatment is performed by a monopolar electrolysis process in which a positive side application is only made or a bipolar electrolysis process in which a composite application of positive and negative sides is made.

12. The method of electrolytic ceramic coating according to claim 10, wherein at least one voltage waveform is selected from the group consisting of square waveform, sinusoidal waveform, trapezoidal waveform and triangular waveform and has a frequency of 5 to 20,000 Hz, and the current density and/or the voltage on the positive and negative sides is controlled.

13. The method of electrolytic ceramic coating according to claim 10, wherein at least part of the anodizing treatment is performed under voltage control mode and another part of the anodizing treatment is performed under current control mode.

14. The method of electrolytic ceramic coating according to claim 11, wherein in the bipolar electrolysis process, at least part of the anodizing treatment is performed while separately controlling the positive and negative sides according to arbitrarily selected waveforms, is performed under the voltage control mode on both of the positive and negative voltage sides, or is performed under the current control mode on both of the positive and negative voltage sides.

15. The method of electrolytic ceramic coating according to claim 11, wherein in the bipolar electrolysis process, at least part of the anodizing treatment is performed while separately controlling the positive and negative sides according to arbitrarily selected waveforms, and is performed under the voltage control mode on the positive voltage side and under the current control mode on the negative voltage side, or is performed under the current control mode on the positive voltage side and under the voltage control mode on the negative voltage side.

16. The method of electrolytic ceramic coating according to claim 10, wherein a peak voltage during negative side application is controlled in a range of 0 to 350 V in terms of absolute value.

17. The method of electrolytic ceramic coating, wherein two or more anodizing treatment steps are performed by an anodization process using an electrolysis solution according to claim 1, the electrolysis solutions for the respective anodizing treatment steps may be the same or different and the anodization processes for the respective anodizing treatment steps may be the same or different.

* * * * *